US011298625B2

(12) United States Patent
Vreugdenhil et al.

(10) Patent No.: US 11,298,625 B2
(45) Date of Patent: Apr. 12, 2022

(54) ACTION FIGURE GAMING ASSEMBLY WITH VARIOUS ATTACK MANEUVERS AND DEATH CONFIGURATIONS

(71) Applicant: Shoot The Moon Products, II, LLC, Pleasanton, CA (US)

(72) Inventors: Johan Vreugdenhil, Pleasanton, CA (US); Russell G. Rasmussen, Pleasanton, CA (US); Richard Corlett, Livermore, CA (US)

(73) Assignee: Shoot the Moon Products, II, LLC, Pleasanton, CA (US)

( * ) Notice: Subject to any disclaimer, the term of this patent is extended or adjusted under 35 U.S.C. 154(b) by 120 days.

(21) Appl. No.: 16/930,314

(22) Filed: Jul. 15, 2020

(65) Prior Publication Data

US 2022/0016537 A1 Jan. 20, 2022

(51) Int. Cl.

| | |
|---|---|
| ***A63H 13/06*** | (2006.01) |
| ***A63H 3/50*** | (2006.01) |
| ***A63H 3/16*** | (2006.01) |
| *A63H 31/00* | (2006.01) |

(52) U.S. Cl.

CPC ..... *A63H 13/06* (2013.01); *A63H 3/16* (2013.01); *A63H 3/50* (2013.01); *A63H 31/00* (2013.01)

(58) Field of Classification Search

None

See application file for complete search history.

(56) References Cited

U.S. PATENT DOCUMENTS

| | | | | |
|---|---|---|---|---|
| 1,726,644 A * | 9/1929 | Brinkman | A63H 13/06 446/335 |
| 2,760,306 A * | 8/1956 | Pelletier | A63H 13/06 446/334 |
| 3,235,259 A * | 2/1966 | Glass | A63H 13/06 273/440.1 |
| 3,845,956 A * | 11/1974 | Goldfarb | A63H 13/06 273/440.1 |
| 5,458,523 A | 10/1995 | Aoki et al. | 446/246 |
| 7,475,881 B2 * | 1/2009 | Blagg | A63F 9/00 273/440.1 |

* cited by examiner

*Primary Examiner* — John A Ricci
(74) *Attorney, Agent, or Firm* — Adibi IP Group, PC; Amir V. Adibi; Andrew C. Palmer

(57) ABSTRACT

An action figure gaming assembly includes a controller and an action figure. The controller includes an actuator and a rotating surface. The action figure is attached to and rotates on a rotating surface when the actuator is activated. The action figure performs one of several attack maneuvers (weapon strike, punch, kick, lean and slap, and telescoping first) and one of several death configurations (torso split, disintegration, scissor split, and a forward or backward collapse). During game play, the action figure gaming assembly duels against other action figure gaming assemblies. Activation of the actuator causes the action figure to rotate with the rotation surface of the controller and to strike an opponent. Activation of the trigger portion by an opponent causes the action figure to transition to the death mode. In the death mode, part of a first body portion separates from part of a second body portion.

20 Claims, 39 Drawing Sheets

ACTION FIGURE ASSEMBLY DURING GAME PLAY (IDLE MODE)

ACTION FIGURE ASSEMBLY (DEATH MODE)

ACTION FIGURE ASSEMBLY

ACTION FIGURE ASSEMBLY DURING GAME PLAY
(IDLE MODE)

ACTION FIGURE ASSEMBLY
(ATTACK MODE)

ACTION FIGURE ASSEMBLY
(DEATH MODE)

RIGHT ARM ROTATION WITH SWORD
(FRONT VIEW)

RIGHT ARM ROTATION WITH SWORD
(BACK VIEW)

HAND AND WEAPON

HAND AND WEAPON

RIGHT ARM ROTATION FRONT VIEW

LEFT ELBOW MOVEMENT

LEFT ELBOW MOVEMENT

PUNCH STRIKE

PUNCH STRIKE

PUNCH STRIKE

PUNCH STRIKE

KICKING STRIKE

KICKING STRIKE

LEAN AND SLAP STRIKE

LEAN AND SLAP STRIKE

LEAN AND SLAP STRIKE

LEAN AND SLAP STRIKE

TELESCOPING FIST STRIKE

TELESCOPING FIST STRIKE

TORSO SPLIT DEATH
(IDLE MODE)

TORSO SPLIT DEATH
(DEATH MODE)

DISINTEGRATION DEATH
(IDLE MODE)

DISINTEGRATION DEATH
(DEATH MODE)

SCISSOR SPLIT DEATH

SCISSOR SPLIT DEATH

COLLAPSE BACKWARD DEATH

COLLAPSE BACKWARD DEATH

COLLAPSE FORWARD DEATH

COLLAPSE FORWARD DEATH

CONTROLLER
(BUTTON ACTUATOR)

CONTROLLER
(BUTTON ACTUATOR)

CONTROLLER
(BUTTON ACTUATOR)

TOP VIEW OF CONTROLLER
(DIMENSIONS IN MILLIMETERS)

FRONT VIEW OF CONTROLLER
(DIMENSIONS IN MILLIMETERS)

LEFT SIDE VIEW OF CONTROLLER
(DIMENSIONS IN MILLIMETERS)

RIGHT SIDE VIEW OF CONTROLLER
(DIMENSIONS IN MILLIMETERS)

CONTROLLER
(JOYSTICK ACTUATOR)

CONTROLLER
(JOYSTICK ACTUATOR)

CONTROLLER
(JOYSTICK ACTUATOR)

TOP VIEW OF CONTROLLER
(DIMENSIONS IN MILLIMETERS)

FRONT VIEW OF CONTROLLER
(DIMENSIONS IN MILLIMETERS)

LEFT SIDE VIEW OF CONTROLLER
(DIMENSIONS IN MILLIMETERS)

RIGHT SIDE VIEW OF CONTROLLER
(DIMENSIONS IN MILLIMETERS)

CONTROLLER
(ANOTHER EMBODIMENT)

ACTION FIGURE ASSEMBLY
(ANOTHER EMBODIMENT)

ACTION FIGURE ASSEMBLY
(ANOTHER EMBODIMENT)

ACTION FIGURE ASSEMBLY
(ANOTHER EMBODIMENT)

ACTION FIGURE ASSEMBLY
(ANOTHER EMBODIMENT)

ACTION FIGURE
(ANOTHER EMBODIMENT)

PROVIDING AN ACTION FIGURE ASSEMBLY

MANUFACTURING A PACKAGED ACTION FIGURE ASSEMBLY

ACTION FIGURE GAMING ASSEMBLY WITH VARIOUS ATTACK MANEUVERS AND DEATH CONFIGURATIONS

TECHNICAL FIELD

The present invention relates generally to action figures, and more specifically, to action figure gaming assemblies.

BACKGROUND INFORMATION

An action figure is a popular toy. In some examples, action figures are rigid structures that do not have moving components. In other examples, action figures are dynamic structures that have rotating or moving components. The action figures that are dynamic often perform various martial arts fighting maneuvers. These dynamic action figures are typically manipulated and controlled directly or are controlled by a remotely controllable mechanism.

SUMMARY

An action figure gaming assembly includes a controller and an action figure. The controller includes an actuator and a rotating surface. The actuator and rotating surface are on opposite ends of the controller. The action figure is attached to and rotates on a rotating surface when the actuator is activated. The action figure performs one of several attack maneuvers and one of several death configurations. The rotation of the action figure causes body parts and weapons to strike. The strike is generated by a centrifugal force generated by rotation of the action figure, by a mechanism within the action figure, or by interacting with a device attachable to the controller.

In various embodiments shown and described herein, the action figure performs a fighting maneuver selected from the group consisting of: a weapon strike, a punch strike, a kicking strike, a lean and slap strike, a telescoping first strike, and other strikes that involve a body part of the action figure. In other embodiments, fighting maneuvers can use the rotating figure to perform attacks that swivel appendages. In various embodiments, the action figure performs a death maneuver selected from the group consisting of: a torso split death, a disintegration death, a scissor split death, and a forward or backward collapse death.

The action figure includes a first body portion, a second body portion, an attack portion, and a trigger portion. During game play, the action figure has an idle mode, an attack mode, and a death mode. The action figure transitions from the idle mode to the attack mode when the actuator of the controller is activated. The action figure transitions from the attack mode to the idle mode when the actuator of the controller is deactivated. In one example, the actuator of the controller is a button actuator. In another example, the actuator of the controller is a joystick actuator.

During game play, the action figure gaming assembly duels against other action figure gaming assemblies. Activation of the actuator causes the action figure to rotate with the rotation surface of the controller. Rotation of the action figure generates a centrifugal force that causes an attack portion of the action figure to strike an opponent in accordance with an attack maneuver. In one embodiment, the controller includes a spring mechanism that causes the action figure to rotate back to the idle mode after the actuator is released or deactivated.

An action figure is killed when an opponent strikes the trigger portion of the action figure. Activation of the trigger portion by an opponent causes the action figure to die in accordance with the death configuration. In the death mode, part of a first body portion separates from part of a second body portion. In some embodiments, an item that was at least partially hidden within the action figure is released. After the action figure transitions to the death mode, at least part of the action figure remains attached to the controller. The action figure is not ejected from the rotating surface after entering the death mode. In one embodiment, the trigger portion includes a head of the action figure that is connected to a latch. The latch maintains the first body portion and second body portion attached. When an opponent strikes the head, the latch is released causing the first body portion to separate from the second body portion.

Further details and embodiments and methods are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 1:
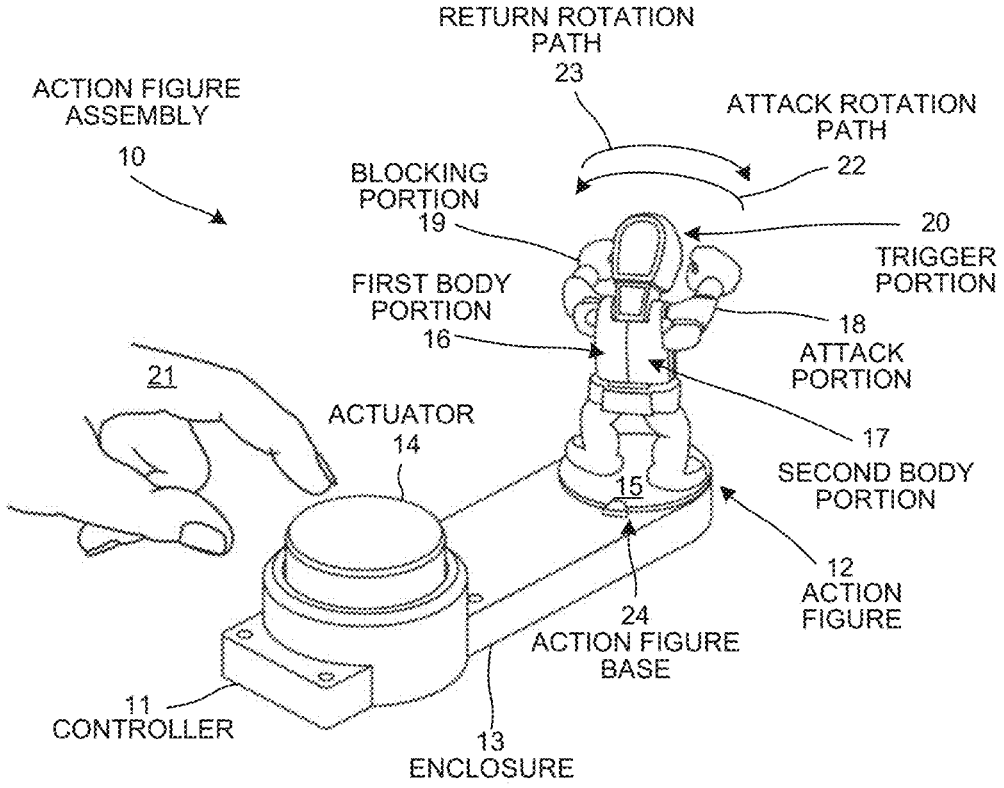
FIG. 1 is a diagram of an action figure assembly 10.
Figure 12:
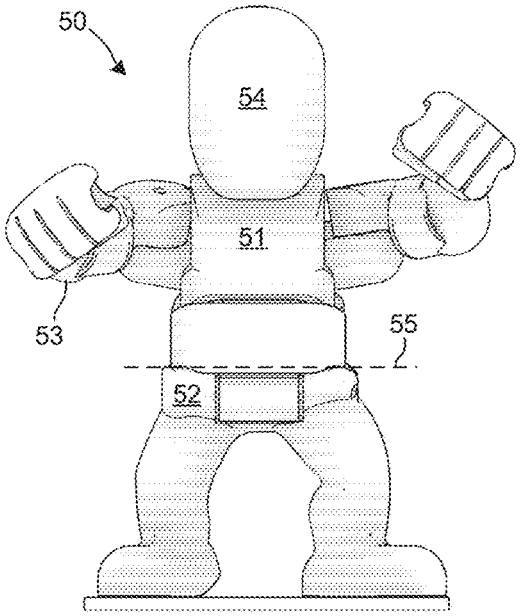
FIG. 12 is a diagram of a front perspective view showing an embodiment of an action figure 50 that performs a punching attack maneuver.

FIG. 1 is a diagram of an action figure assembly 10. The action figure assembly 10 comprises a controller 11 and an action figure 12. The controller 11 comprises an enclosure 13, an actuator 14, and a rotating surface 15. The action figure 12 comprises a first body portion 16, a second body portion 17, an attack portion 18, a blocking portion 19, and a trigger portion 20. The action figure 12 is attached to the rotating surface 15 of the controller 11. The actuator 14 controls rotation of the rotating surface 15. The actuator 14 may be a button, joystick, or other user input that activates rotation of the rotating surface 15. In one embodiment, the controller includes no electronic components. The controller includes only mechanical components and does not include any batteries, motors, sensors, or processors.

A user 21 controls operation of the action figure 12 using the actuator 14 of the controller 11. The action FIG. 12 is operable to perform an attack maneuver. Upon activation of the actuator 14, the action figure 12 transitions from an idle mode to an attack mode by rotating along an attack rotation path 22. Next, the action figure 12 transitions from the attack mode back to the idle mode by rotating along a return rotation path 23.

The action figure 12 is attached to and rotates with the rotating surface 15. The rotating surface 15 may also be referred to as a stage or a platform. Activation of the actuator 14 causes the rotating surface 15 to rotate clockwise or counter-clockwise. In this example, the rotating surface 15 rotates counter-clockwise upon activation of the actuator 14. When the actuator 14 is activated, the action figure 12 rotates causing the action figure 12 to transition from the idle mode to the attack mode. De-activation of the actuator 14 causes the rotating surface 15 to rotate from the attack mode back to the idle mode.

In the attack mode, the action figure 12 performs an attack maneuver that mimics an action figure attack. The attack maneuver is dependent upon the action figure 12. Different action figures have different attack portions each of which is capable of performing a different attack maneuver. In various embodiments, the attack portion comprises an element taken from the group consisting of: an arm holding a weapon operable to perform a weapon striking maneuver, an arm operable to perform a punching maneuver, a leg operable to perform a kicking maneuver, a torso operable to perform a lean and slap striking maneuver, and a telescoping first operable to perform a telescoping arm striking maneuver. In this example, the attack portion 18 is an arm that performs a punching attack maneuver when the actuator 14 is activated.

In one embodiment, the action figure 12 is removable from the controller 11 and interchangeable with another action figure that attaches to the rotating surface 15. This allows the user 21 to select their action figure of choice and attack maneuver for a match.

Figure 2:
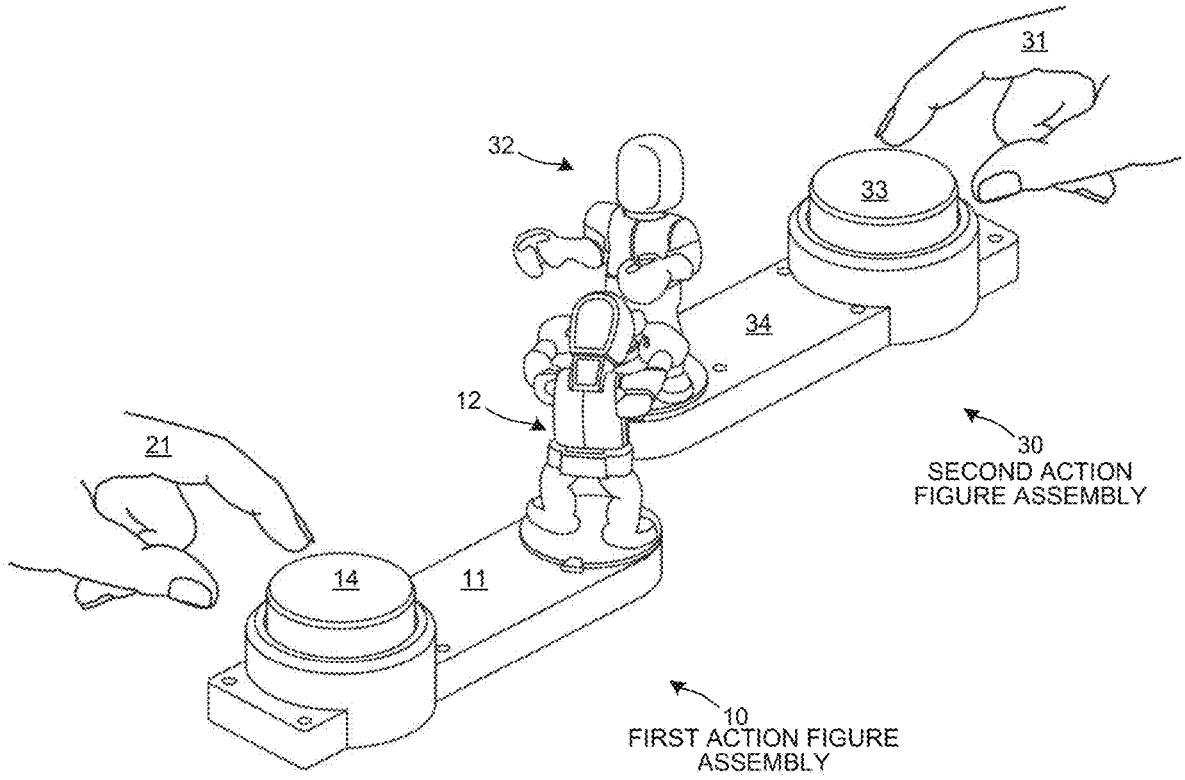
FIG. 2 is a diagram showing the action figure assembly 10 in the idle mode.
Figure 14:
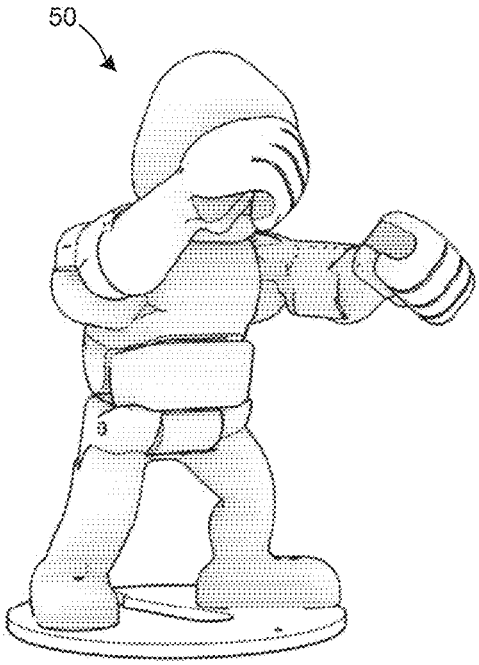
FIG. 14 is a diagram of another perspective view showing the action figure 50.

FIG. 2 is a diagram showing the action figure assembly 10 in the idle mode. The first action figure assembly 10 is shown in a duel against a second action figure assembly 30. The second action figure assembly 30 is operated by a second user 31. The second user 31 controls operation of an action figure 32 using actuator 33 of controller 34. In the example of FIG. 2, the first user 33 and the second user 37 are in a gaming match. In this example, actuators 14 and 33 are button actuators. Neither actuator 14 or 33 is pressed and both action figures 14 and 33 are in the idle mode.

Figure 3:
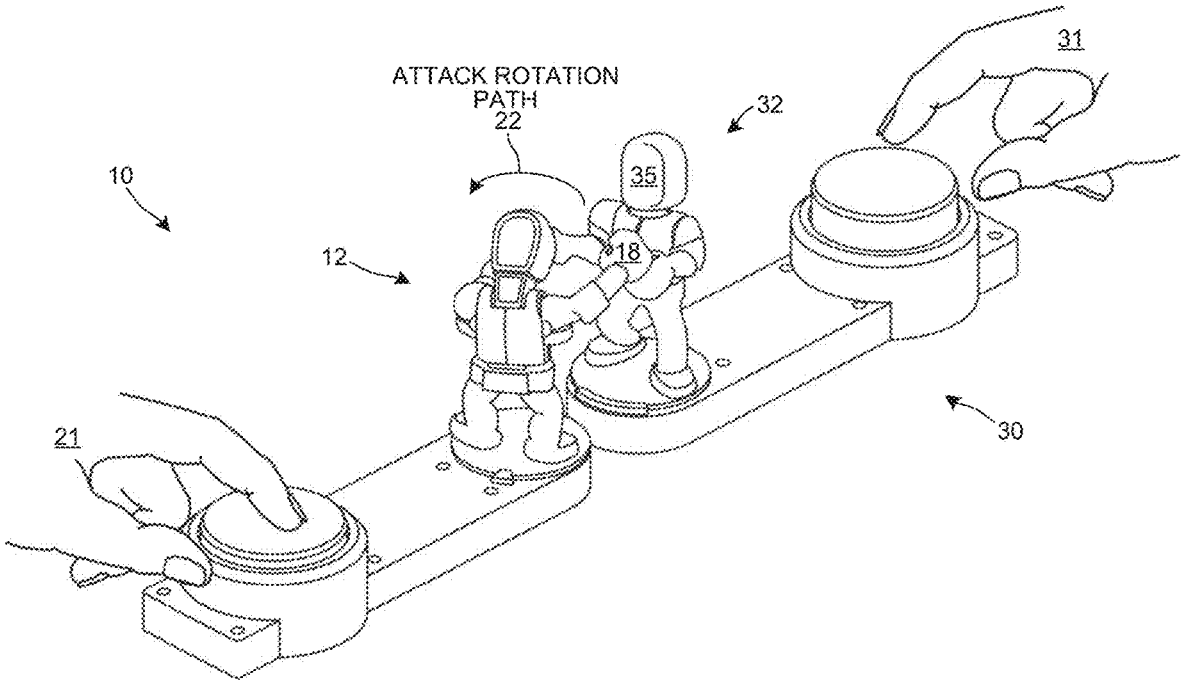
FIG. 3 is a diagram showing a perspective view of the action figure assembly 10 in the attack mode.
Figure 4:
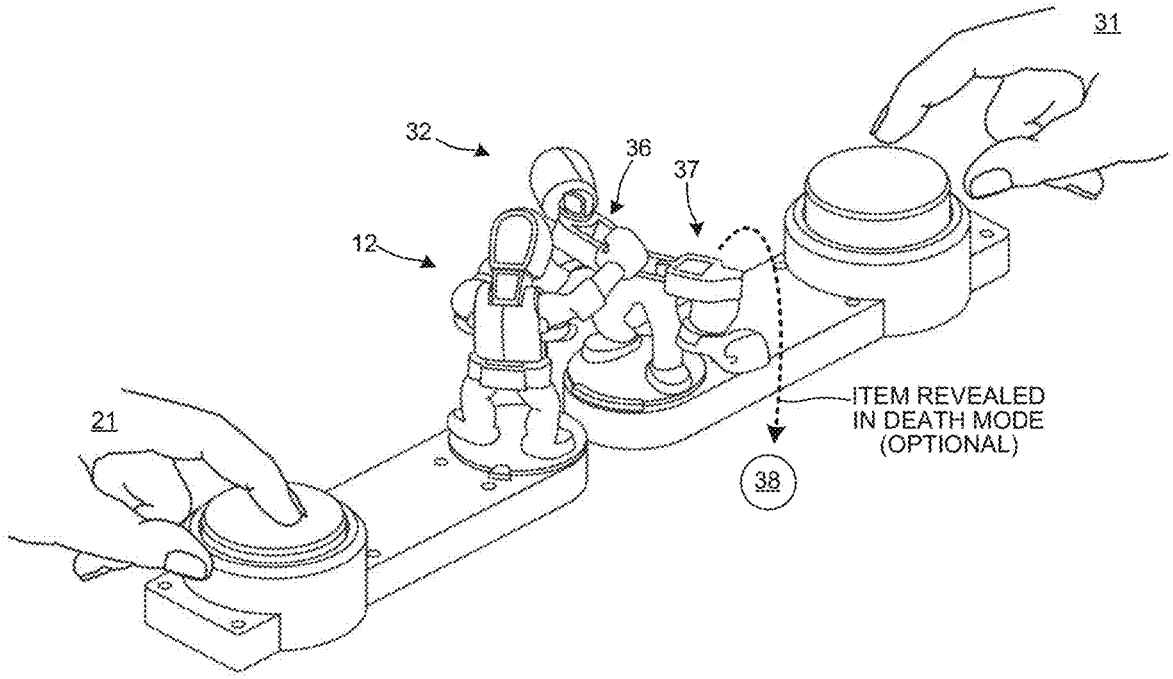
FIG. 4 is a diagram showing a perspective view of the action figure assembly 30 in the death mode.

FIG. 3 is a diagram showing a perspective view of the action figure assembly 10 in the attack mode. The first user 21 presses down on button actuator 14 causing the first action figure 12 to rotate along the attack rotation path 22. The centrifugal force generated during the rotation causes the attack portion 18 to strike a trigger portion 35 of the second action figure 32. This attack causes the second action figure 32 to enter a death mode as shown in FIG. 4. In this example, the attack portion 18 is an attacking arm and the trigger portion 35 is a head of the action figure 32.

FIG. 4 is a diagram showing a perspective view of the action figure assembly 30 in the death mode. After the attacking arm 18 of action figure 12 strikes the head 35 of the action figure 32, the action figure 32 enters the death mode. In this example, the death mode involves an upper body of the action figure 32 splitting at the torso. When the action figure 32 transitions to the death mode, a first body portion 36 separates from a second body portion 37. The first user 21 has beat the second user 31.

In some embodiments, entering the death mode causes an item to be revealed. In one example, an item 38 is at least partially disposed within the action figure 32. When first body portion 36 separates from the second body portion 37 in the death mode, the item 38 is dislodged and falls out from within the body of the action figure 32. The first user 21 takes the item 38 as a prize of victory over winning the gaming match against the second user 31.

Figure 5:
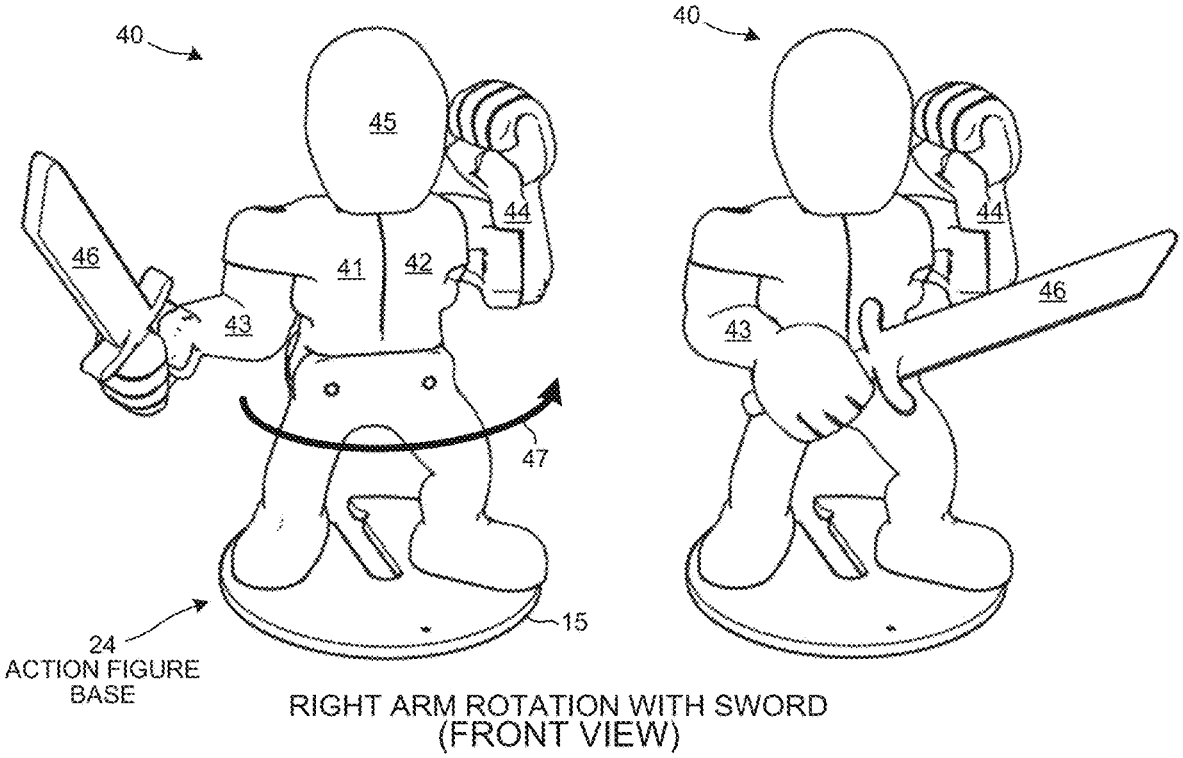
FIG. 5 is a diagram of a front perspective view showing an embodiment of an action figure 40 transitioning from an idle mode to an attack mode.
Figure 40:
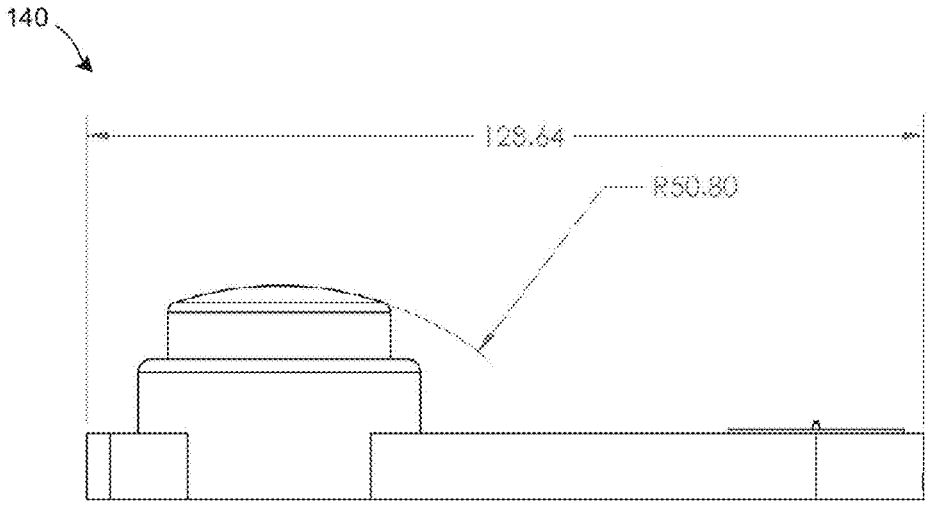
FIG. 40 is a diagram of a left-side view of the controller 140 showing dimensions of one embodiment.

FIG. 5 is a diagram of a front perspective view showing an embodiment of an action figure 40 transitioning from an idle mode to an attack mode. The action figure 40 is part of an action figure assembly as shown in FIG. 1. Action figure 40 has a first body portion 41, a second body portion 42, an attack portion 43, a blocking portion 44, and a trigger portion 45. In this example, the attack portion 43 is a striking arm, the blocking portion 44 is a blocking arm, and the trigger portion 45 includes a head that is connected to a latch that maintains the body portions 41 and 42 together. The striking arm 43 holds a weapon 46. In this example, the weapon 46 is a sword. The sword 46 is interchangeable with other weapons provided by a provider of the action figure 40. The action figure 40 shown on the left of FIG. 5 is in the idle mode prior to striking.

The action figure 40 shown on the right of FIG. 5 is fully rotated on the controller and is shown at the end rotation that is the end position of the attack mode. During rotation of action figure 40 the left arm is pushed bank against a hard stop and the weapon 46 is moved forward in hand slot 49 due to centrifugal force and gravity. Reference numeral 47 identifies the rotation of the striking arm 43. Reference numeral 47A identifies the forward motion of weapon 46 in hand slot 49 of arm 43. The rotating motion of the action figure, arm rotation and weapon movement are the attack mode. Positions of arms and weapons can be controlled by changing speed, acceleration and timing of controller activation.

Figure 6:
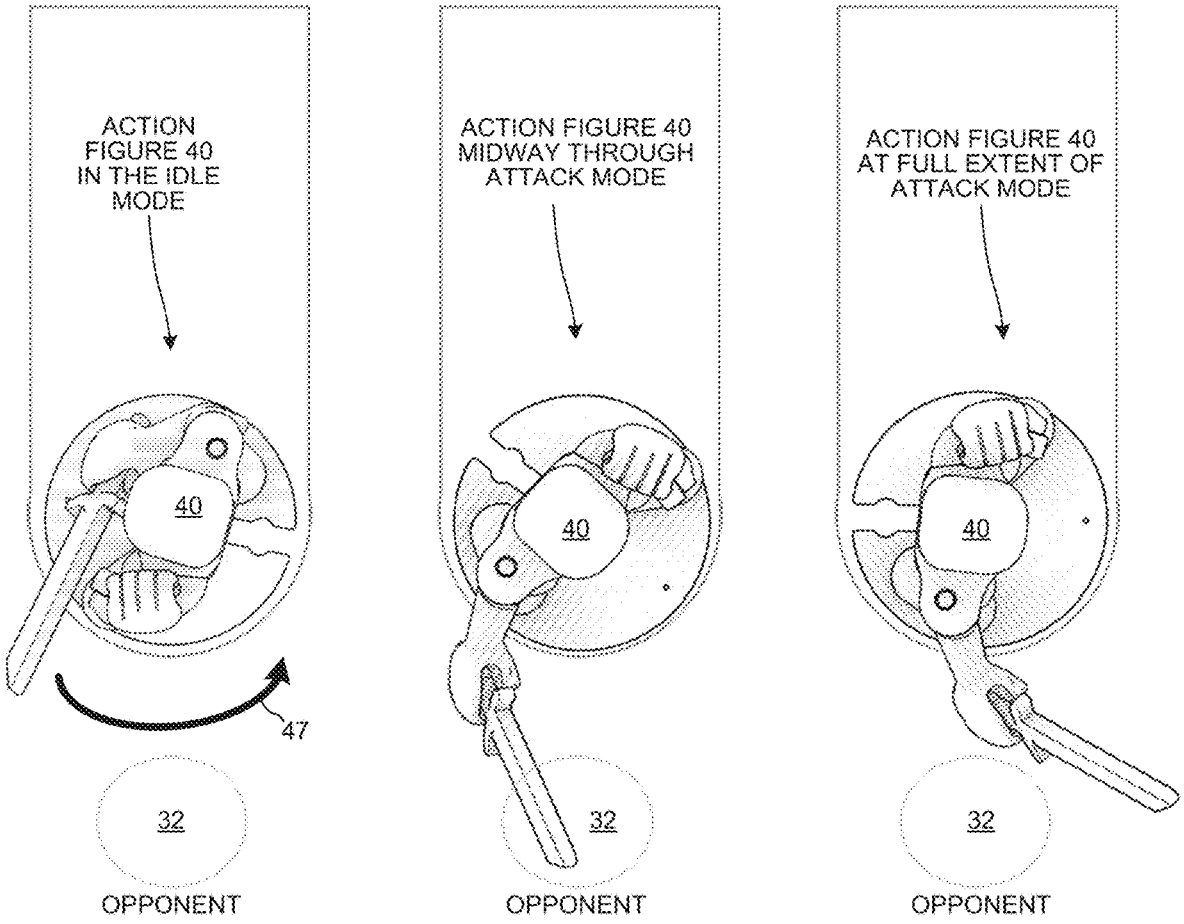
FIG. 6 is a diagram of a top perspective view showing the action figure 40 transitioning from the idle mode to the attack mode.

FIG. 6 is a diagram of a top perspective view showing the action figure 40 transitioning from the idle mode to the attack mode. The left-most drawing shows the action figure 40 in the idle mode prior to initiating a striking maneuver in the action mode. The middle drawing shows the action figure 40 midway through the striking maneuver in the action mode. The right-most drawing shows the action figure 40 at a full extent of the striking maneuver in the action mode.

Figure 7:
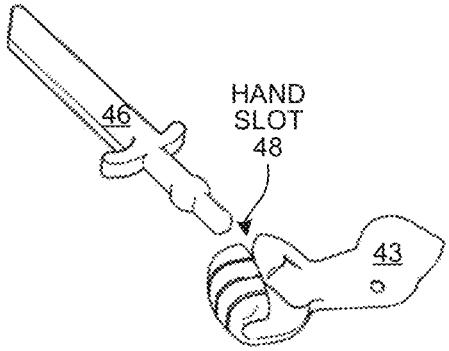
FIG. 7 is a diagram of an expanded, rear perspective view of the striking arm 43 and weapon 46.

FIG. 7 is a diagram of an expanded, rear perspective view of the striking arm 43, a weapon 46, and a hand slot 48. The weapon 46 is attachable to and removable from the striking arm 43. Weapons may be swapped in and out of the striking arm 43 based on user preference. In this example, the sword 46 is inserted into the hand slot 48. In other embodiments, other attachment techniques are employed to attach weapons to the attacking arm.

Figure 8:
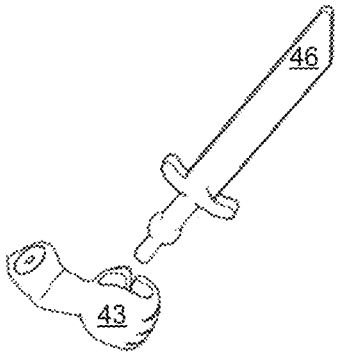
FIG. 8 is a diagram of an expanded, front perspective view of the striking arm 43 and the weapon 46 of the action figure 40.

FIG. 8 is a diagram of an expanded, front perspective view of the striking arm 43, the weapon 46, and the hand slot 49 of the action figure 40.

Figure 9:
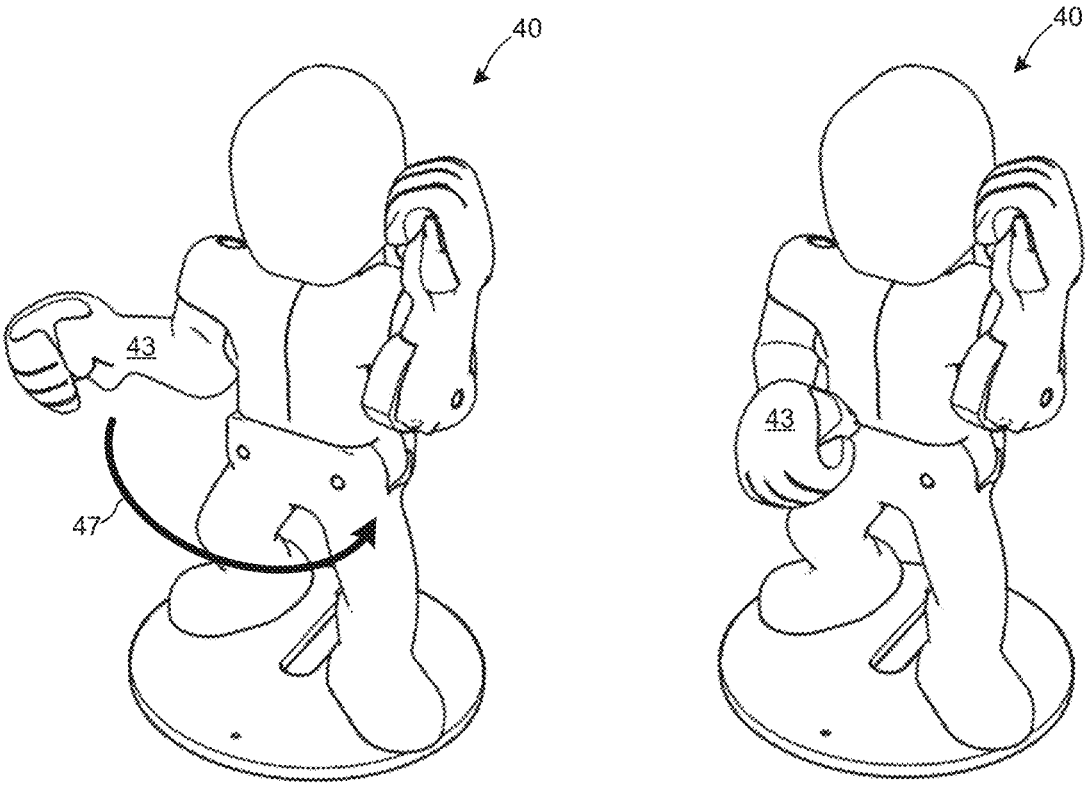
FIG. 9 is a diagram of a front perspective view showing the action figure 40 transitioning from the idle mode to the attack mode without a weapon.

FIG. 9 is a diagram of a front perspective view showing the action figure 40 transitioning from the idle mode to the end position of attack mode without a weapon.

Figure 10:
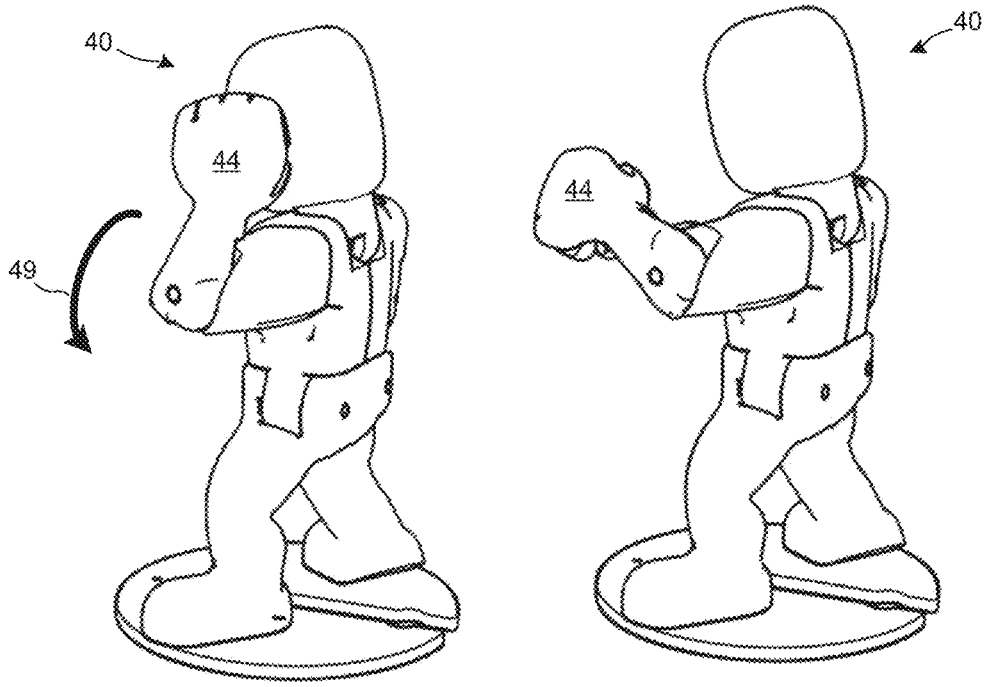
FIG. 10 is a diagram of a rear perspective view of the action figure 40 showing operation of the blocking arm 44.

FIG. 10 is a diagram of a rear perspective view of the action figure 40 showing operation of the blocking arm 44. The centrifugal force generated by rotation of rotating surface 15 causes the blocking arm 44 to rotate downwards in one direction and upward in the other direction. Reference numeral 49 identifies the downward rotation of the blocking arm 44.

Figure 11:
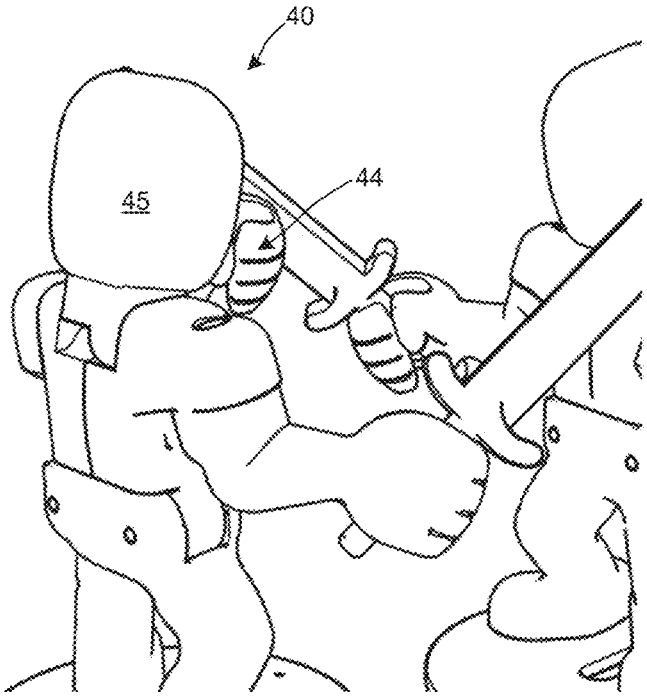
FIG. 11 is a diagram of a perspective view of the action figure 40 using the blocking arm 44.

FIG. 11 is a diagram of a perspective view of the action figure 40 using the blocking arm 44. The blocking arm 44 blocks an opponent's weapon from striking the trigger portion 45. One strategy for achieving a kill is for the striking action figure to strike when the opponent is rotating backwards because the blocking portion is out of the way and the trigger portion is left unprotected.

Figure 50:
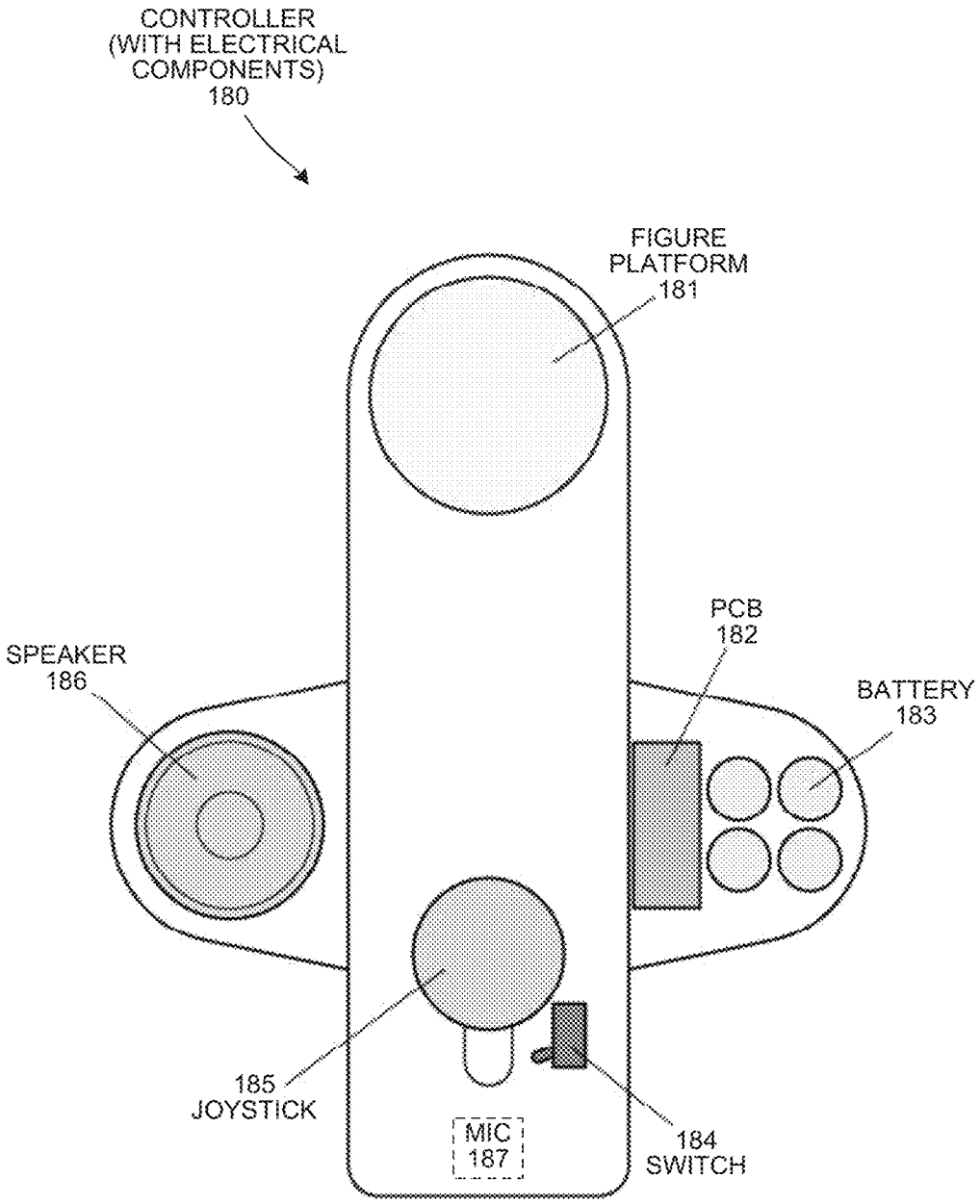
FIG. 50 is a diagram of another embodiment of a controller 180.

FIG. 12 is a diagram of a front perspective view showing an embodiment of an action figure 50 that performs a punching attack maneuver. The action figure 50 performs a punching attack maneuver when transitioning from an idle mode to an attack mode. Action figure 50 has a first body portion 51, a second body portion 52, an attack portion 53, and a trigger portion 54. In this example, the attack portion 53 is a punching arm, and the trigger portion 54 includes a head that is connected to a latch that maintains the body portions 51 and 52 together. In this example, the body portions 51 and 52 separate along a mid-portion of the action figure 50 when trigger 54 is activated and the character 50 transitions to the death mode. Reference numeral 55 identifies this midportion along which the body portions 51 and 52 separate.

Figure 13:
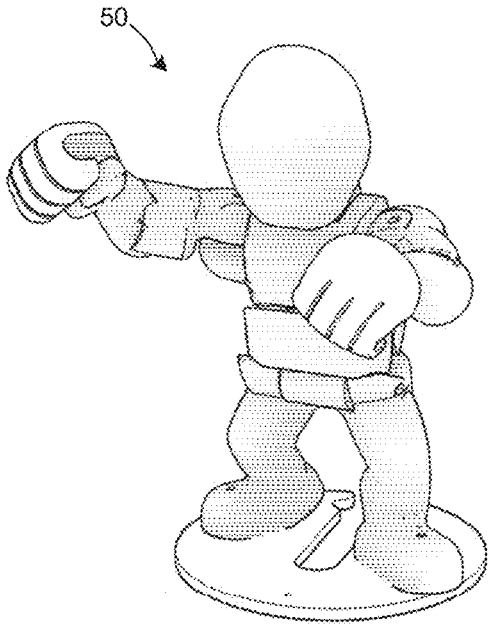
FIG. 13 is a diagram of another perspective view showing the action figure 50.

FIG. 13 is a diagram of another perspective view showing the action figure 50.

FIG. 14 is a diagram of another perspective view showing the action figure 50.

Figure 15:
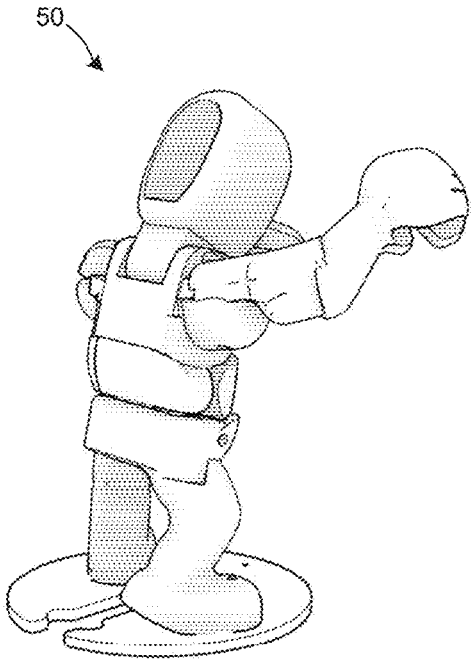
FIG. 15 is a diagram of another perspective view showing the action figure 50.

FIG. 15 is a diagram of another perspective view showing the action figure 50.

Figure 16:
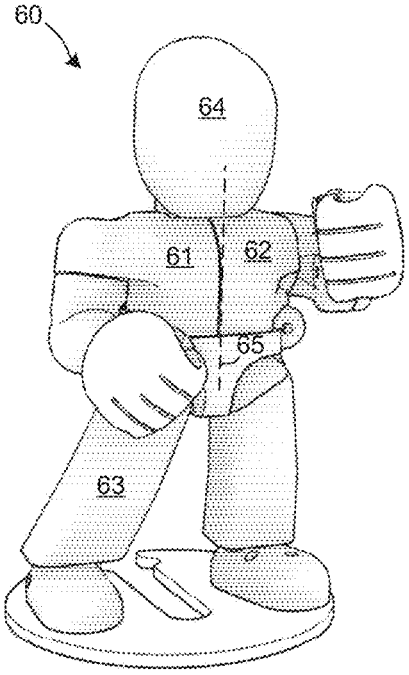
FIG. 16 is a diagram of a front perspective view showing an embodiment of an action figure 60 that performs a kicking attack maneuver.
Figure 60:
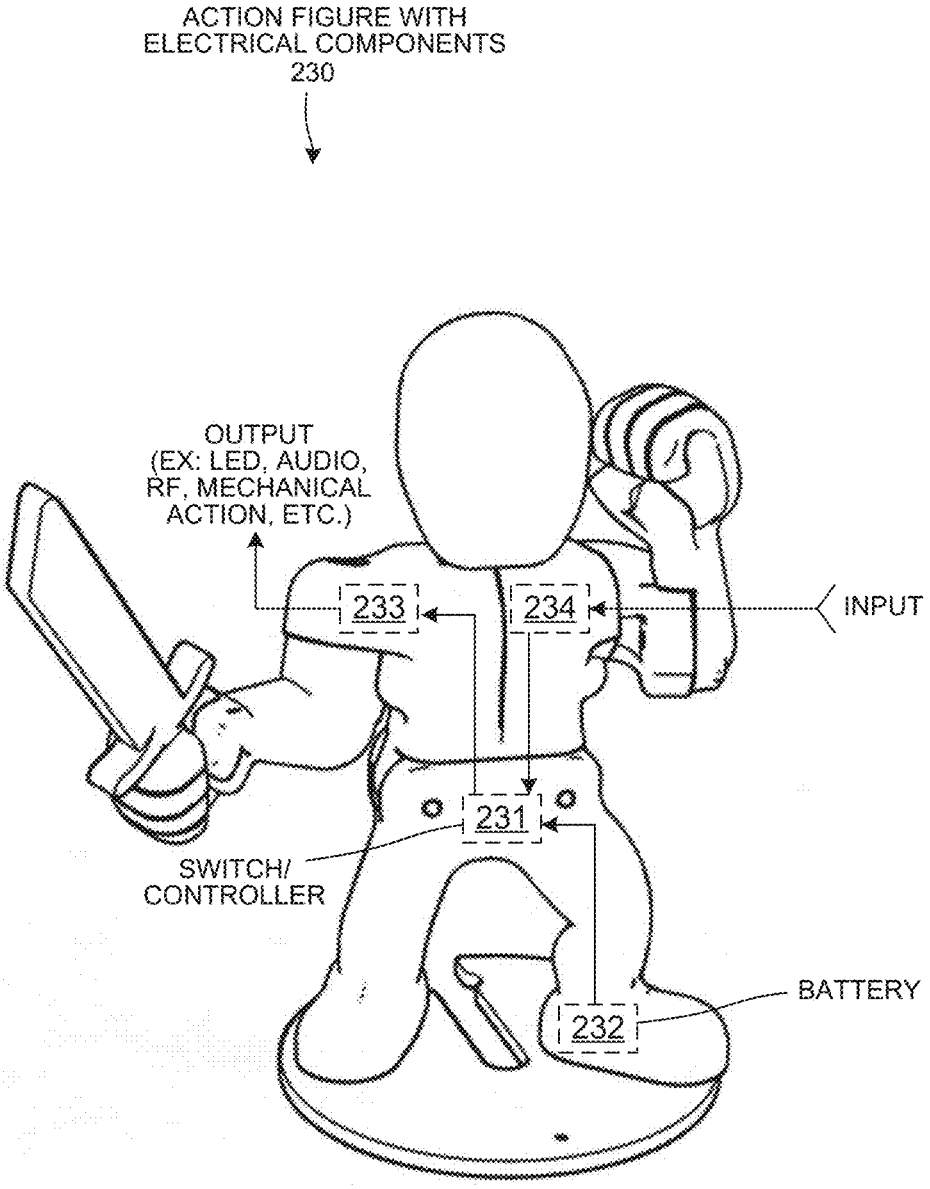
FIG. 60 is a diagram of another embodiment of an action figure 230 that includes electrical components.

FIG. 16 is a diagram of a front perspective view showing an embodiment of an action figure 60 that performs a kicking attack maneuver. The action figure 60 performs a kicking attack maneuver when transitioning from an idle mode to an attack mode. Action figure 60 has a first body portion 61, a second body portion 62, an attack portion 63, and a trigger portion 64. In this example, the attack portion 63 is a kicking leg, and the trigger portion 64 includes a head that is connected to a latch that maintains the body portions 61 and 62 together. In this example, the body portions 61 and 62 separate along a mid-portion of the action figure 60 when trigger 64 is activated and the character 50 transitions to the death mode. Reference numeral 65 identifies this midportion along which the body portions 61 and 62 separate.

Figure 17:
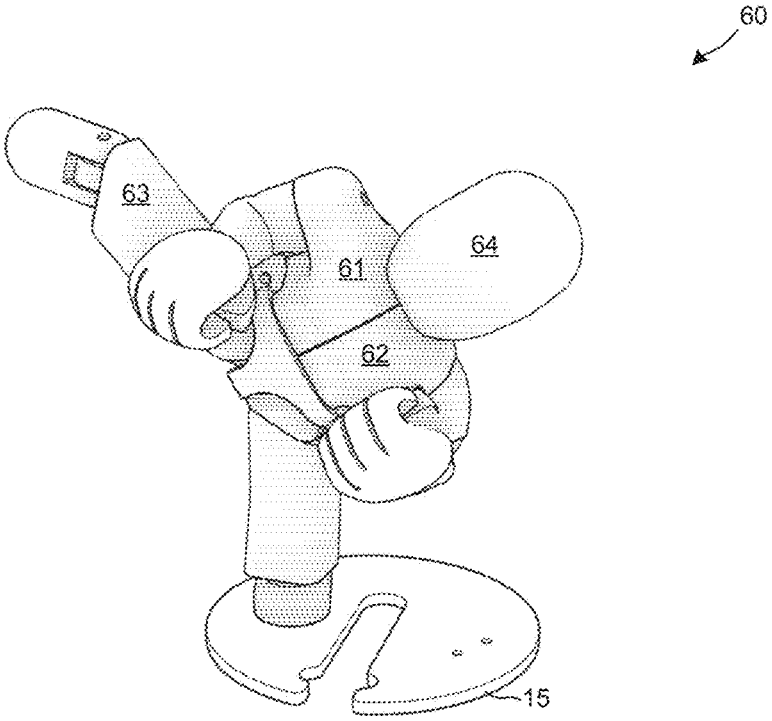
FIG. 17 is a diagram of another perspective view showing the action figure 60 in the attack mode.

FIG. 17 is a diagram of another perspective view showing the action figure 60 in the attack mode. A centrifugal force generated by rotation of the action figure driven by controller rotating surface 15 causes the leg 63 to swing upwards and strike an opponent.

Figure 18:
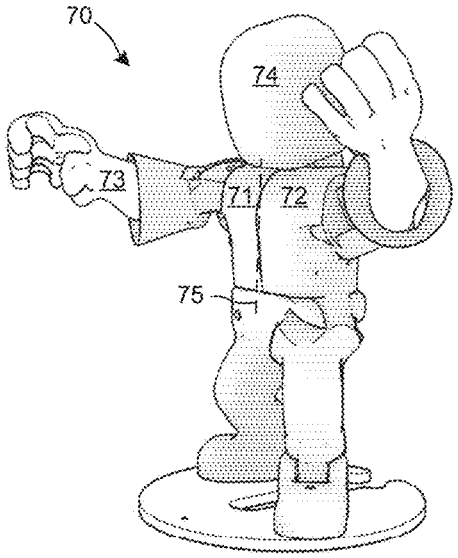
FIG. 18 is a diagram of a perspective view showing an embodiment of an action figure 70 that performs a lean and slap attack maneuver.

FIG. 18 is a diagram of a perspective view showing an embodiment of an action figure 70 that performs a lean and slap attack maneuver. The action figure 70 performs a lean and slap attack maneuver when transitioning from an idle mode to an attack mode. Action figure 70 has a first body portion 71, a second body portion 72, an attack portion 73, and a trigger portion 74. In this example, the attack portion 73 is a slapping arm, and the trigger portion 74 includes a head that is connected to a latch that maintains the body portions 71 and 72 together. In this example, the body portions 71 and 72 separate along a mid-portion of the action figure 70 when trigger 74 is activated and the character 70 transitions to the death mode. Reference numeral 75 identifies this midportion along which the body portions 71 and 72 separate.

Figure 19:
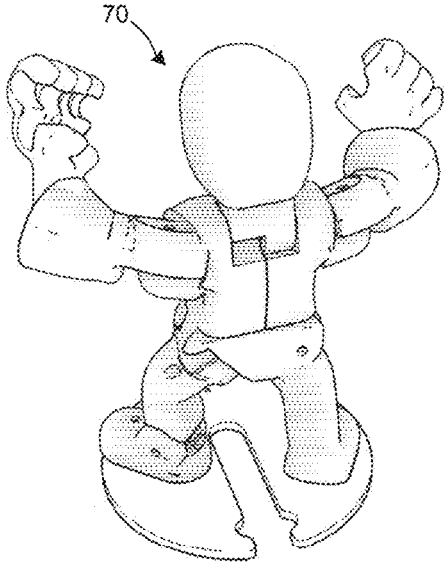
FIG. 19 is a diagram of rear, perspective view showing the action figure 70 in the idle mode.

FIG. 19 is a diagram of rear, perspective view showing the action figure 70 in the idle mode.

Figure 20:
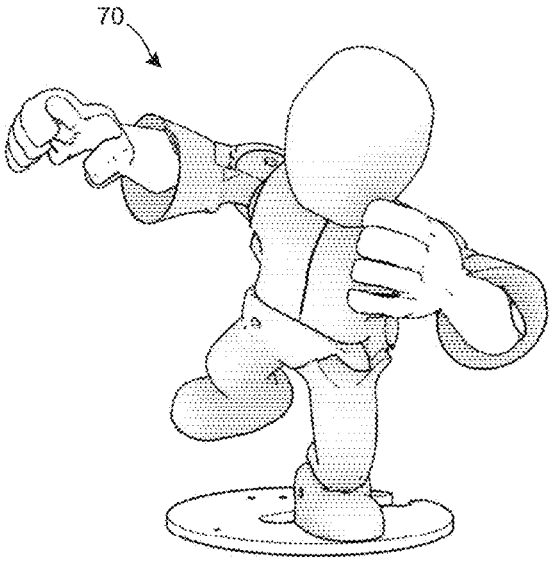
FIG. 20 is a diagram of a front perspective view showing the action figure 70 in the attack mode.

FIG. 20 is a diagram of a front perspective view showing the action figure 70 in the attack mode.

Figure 21:
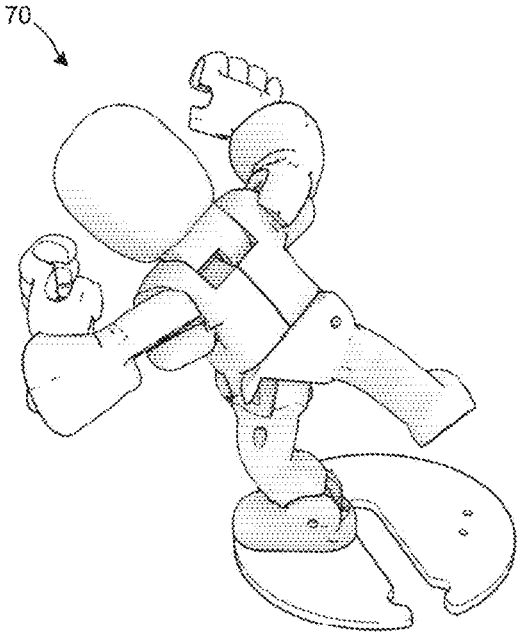
FIG. 21 is a diagram of rear perspective view showing the action figure 70 in the attack mode.

FIG. 21 is a diagram of rear perspective view showing the action figure 70 in the attack mode.

Figure 22:
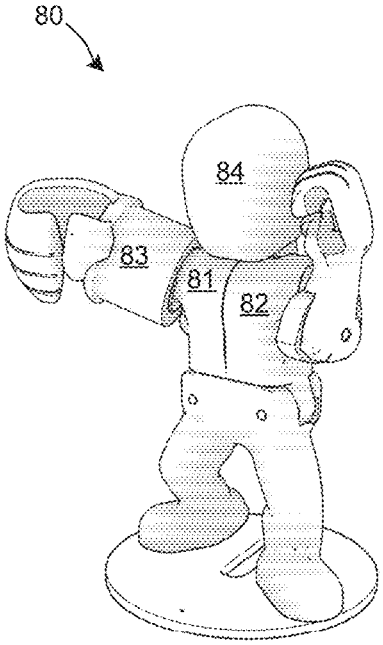
FIG. 22 is a diagram of a front perspective view showing an embodiment of an action figure 80 that performs a telescoping first attack maneuver.

FIG. 22 is a diagram of a front perspective view showing an embodiment of an action figure 80 that performs a telescoping first attack maneuver. The action figure 80 performs a telescoping first attack maneuver when transitioning from an idle mode to an attack mode. Action figure 80 has a first body portion 81, a second body portion 82, an attack portion 83, and a trigger portion 84. In this example, the attack portion 83 is a telescoping fist, and the trigger portion 84 includes a head that is connected to a latch that maintains the body portions 81 and 82 together.

Figure 23:
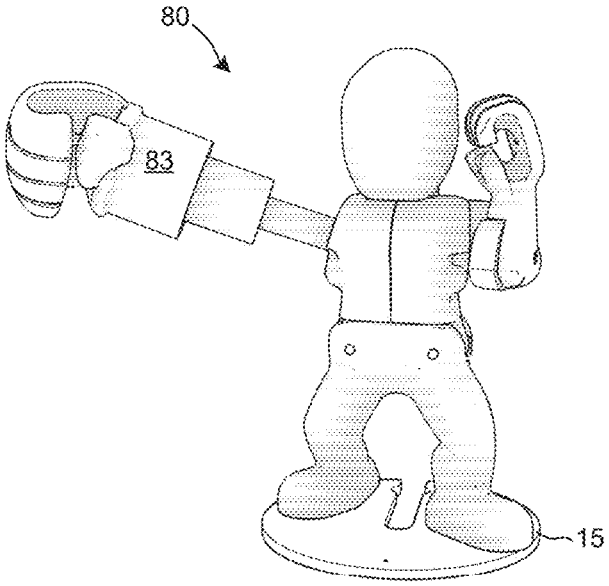
FIG. 23 is a diagram of another perspective view showing the action figure 80 in the attack mode.

FIG. 23 is a diagram of another perspective view showing the action figure 80 in the attack mode. A centrifugal force generated by rotation of the rotating surface 15 causes the telescoping first 83 to extend outwards and strike an opponent.

Figure 24:
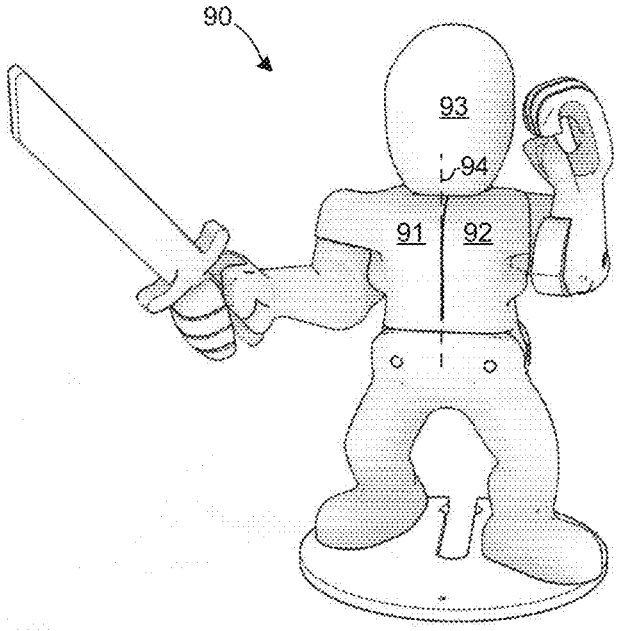
FIG. 24 is a diagram of a front perspective view showing an embodiment of an action figure 90 with a torso split death mode.

FIG. 24 is a diagram of a front perspective view showing an embodiment of an action figure 90 with a torso split death mode. Action figure 90 has a first body portion 91, a second body portion 92, and a trigger portion 93. When the action figure 90 is struck at the trigger portion 93, the first body portion 91 and the second body portion 92 separate along a midsection 94 that is perpendicular to the torso. Reference numeral 94 identifies the midsection along which the body portions 91 and 92 separate when trigger portion 93 is activated.

Figure 25:
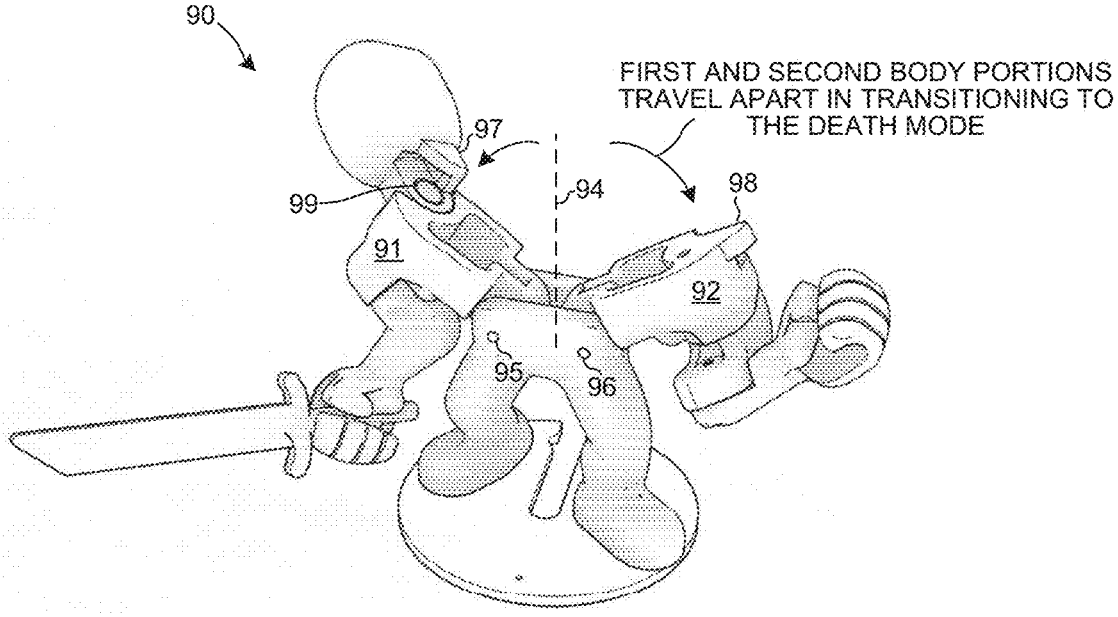
FIG. 25 is a diagram of a front perspective view showing the action figure 90 in the torso split death mode.

FIG. 25 is a diagram of a front perspective view showing the action figure 90 in the torso split death mode. In the torso split death mode, the first body portion 91 travels away and separates from the second body portion 92. During this death mode embodiment, the first body portion 91 and second body portion 92 are released and each rotates about a pin that extends through a torso of the action figure 90. The first body portion 91 rotates about pin 95 and the second body portion 92 rotates about pin 96. In this death mode embodiment, the first body portion 91 and the second body portion 92 remain attached to the action figure 90. In other embodiments, an item is optionally revealed upon entering the torso split death mode.

Prior to action figure 90 splitting apart in the death mode, body portions 91 and 92 of the action figure 90 are held together through latch 97. The latch 97 clamps and retains tab 98. The tab 98 is connected to the second body portion 92. The latch 97 is connected to the first body portion 91 via a pin 99. When the head 93 of the action figure 90 is forced backwards, for example, by an opponent's strike maneuver, the latch 97 rotates clockwise about pin 99 thereby releasing tab 98. Once tab 98 is released, the body portions 91 and 92 of the action figure 90 separate away from each other and action figure 90 splits apart in the death mode.

Figure 26:
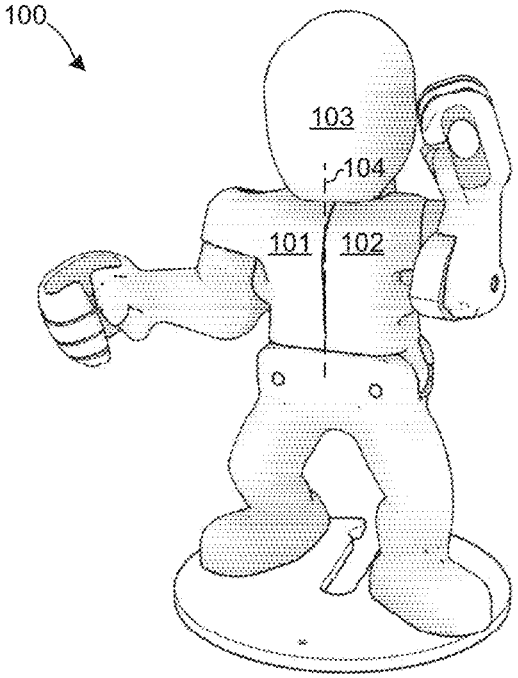
FIG. 26 is a diagram of a front perspective view showing an embodiment of an action figure 100 with a disintegration death mode.

FIG. 26 is a diagram of a front perspective view showing an embodiment of an action figure 100 with a disintegration death mode. Action figure 100 has a first body portion 101, a second body portion 102, and a trigger portion 103. When the action figure 100 is struck at the trigger portion 103, the first body portion 101 and the second body portion 102 separate along a midsection 104 that is perpendicular to the torso. Reference numeral 104 identifies the midsection along which the body portions 101 and 102 separate when trigger portion 103 is activated.

Figure 27:
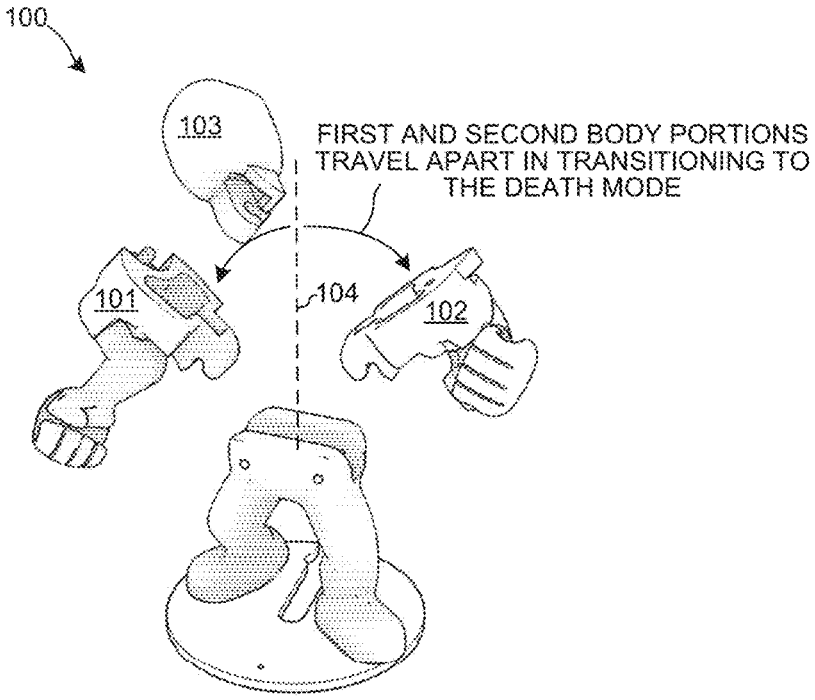
FIG. 27 is a diagram of a front perspective view showing the action figure 100 in the disintegration death mode.

FIG. 27 is a diagram of a front perspective view showing the action figure 100 in the disintegration death mode. In the disintegration death mode, the first body portion 101 travels away and separates from the second body portion 102. In this death mode embodiment, each of the first body portion 101, the second body portion 102, and the trigger portion 103 completely separate from the action figure 100. Because these components 101, 102, and 103 completely separate from the action figure 100, this death mode is referred to as the disintegration death mode. In other embodiments, an item is optionally revealed upon entering the disintegration death mode.

Figure 28:
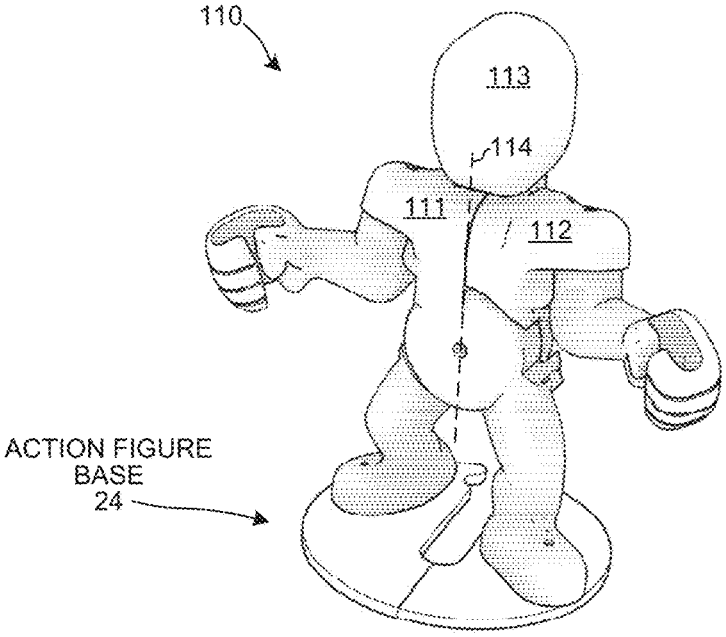
FIG. 28 is a diagram of a front perspective view showing an embodiment of an action figure 110 with a scissor split death mode.

FIG. 28 is a diagram of a front perspective view showing an embodiment of an action figure 110 with a scissor split death mode. Action figure 110 has a first body portion 111, a second body portion 112, and a trigger portion 113. When the action figure 110 is struck at the trigger portion 113, the first body portion 111 and the second body portion 112 separate along a midsection 114 that is perpendicular to the torso. Reference numeral 114 identifies the midsection along which the body portions 111 and 112 separate when trigger portion 113 is activated.

Figure 29:
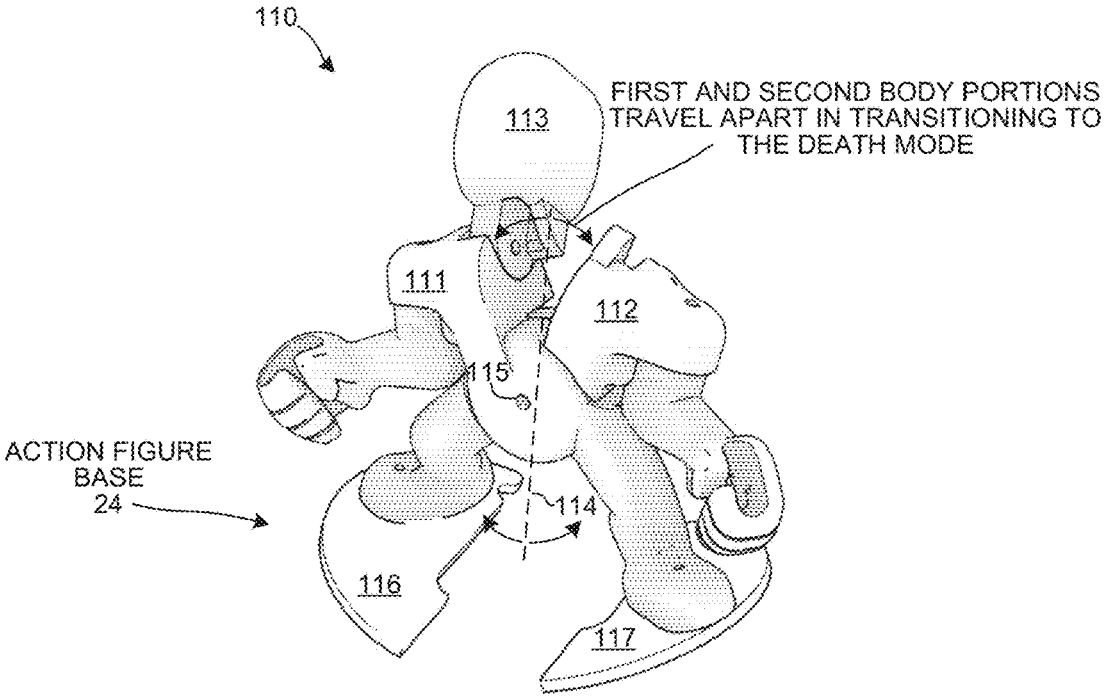
FIG. 29 is a diagram of a front perspective view showing the action figure 110 in the scissor split death mode.

FIG. 29 is a diagram of a front perspective view showing the action figure 110 in the scissor split death mode. In the scissor split death mode, the first body portion 111 travels away and separates from the second body portion 112.

During this death mode, the first body portion 111 and second body portion 112 are released and rotate about a pin 115 that extends through a torso of the action figure 110. In this death mode embodiment, the first body portion 111 and the second body portion 112 remain attached to the action figure 110 and the rotation surface of action figure base 24 separates. The rotation surface includes portions 116 and 117 that separate in the scissor split death mode. In other embodiments, an item is optionally revealed upon entering the scissor split death mode.

Figure 30:
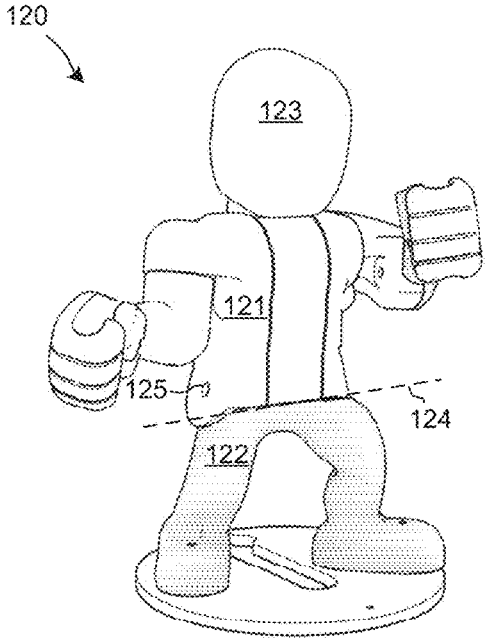
FIG. 30 is a diagram of a front perspective view showing an embodiment of an action figure 120 with a collapse backward death mode.

FIG. 30 is a diagram of a front perspective view showing an embodiment of an action figure 120 with a collapse backward death mode. Action figure 120 has a first body portion 121, a second body portion 122, and a trigger portion 123. When the action figure 120 is struck at the trigger portion 123, the first body portion 121 and the second body portion 122 separate along a midsection 124 that is parallel to the torso. Reference numeral 124 identifies the midsection along which the body portions 121 and 122 separate when trigger portion 123 is activated.

Figure 31:
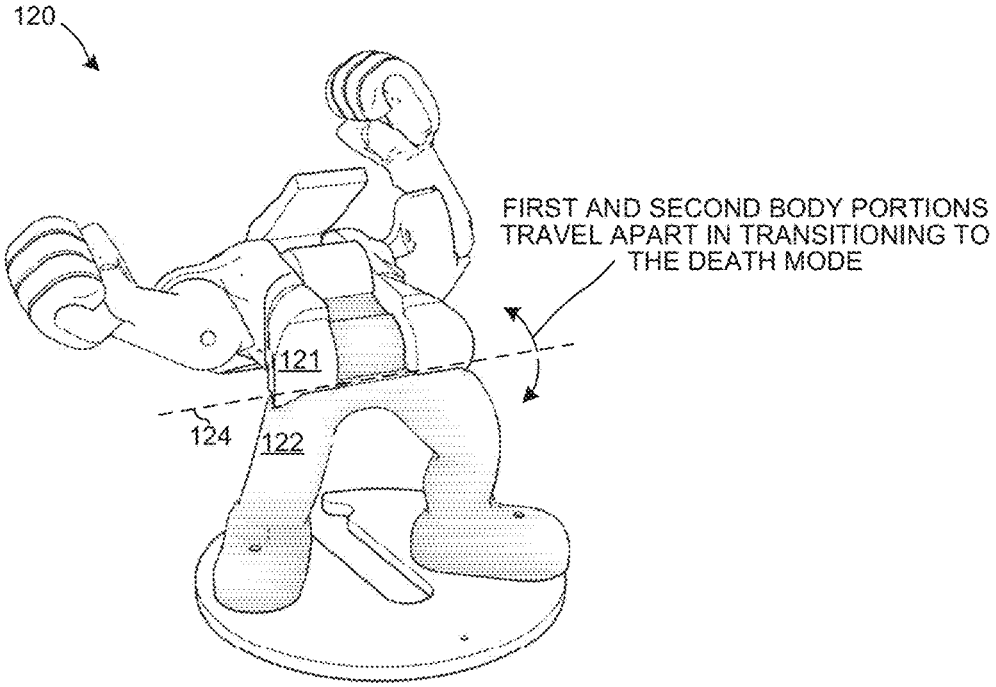
FIG. 31 is a diagram of a front perspective view showing the action figure 120 in the collapse backward death mode.

FIG. 31 is a diagram of a front perspective view showing the action figure 120 in the collapse backward death mode. In the collapse backward death mode, the first body portion 121 travels away and separates from the second body portion 122. During this death mode, the first body portion 121 and second body portion 122 are released and the first body portion 121 collapses backwards. The first body portion 121 rotates about a pin 125 (shown in FIG. 30) that extends through a torso of the action figure 120. In this death mode embodiment, the first body portion 121 and the second body portion 122 remain attached to the action figure 120. In other embodiments, an item is optionally revealed upon entering the collapse backward death mode.

Figure 32:
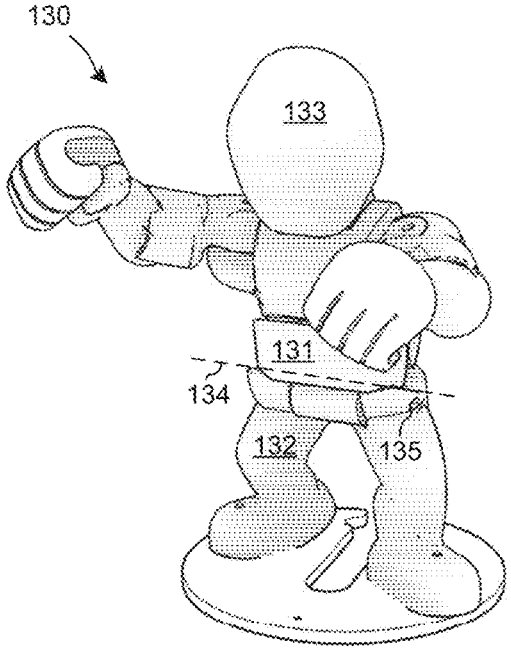
FIG. 32 is a diagram of a front perspective view showing an embodiment of an action figure 130 with a collapse forward death mode.
Figure 33:
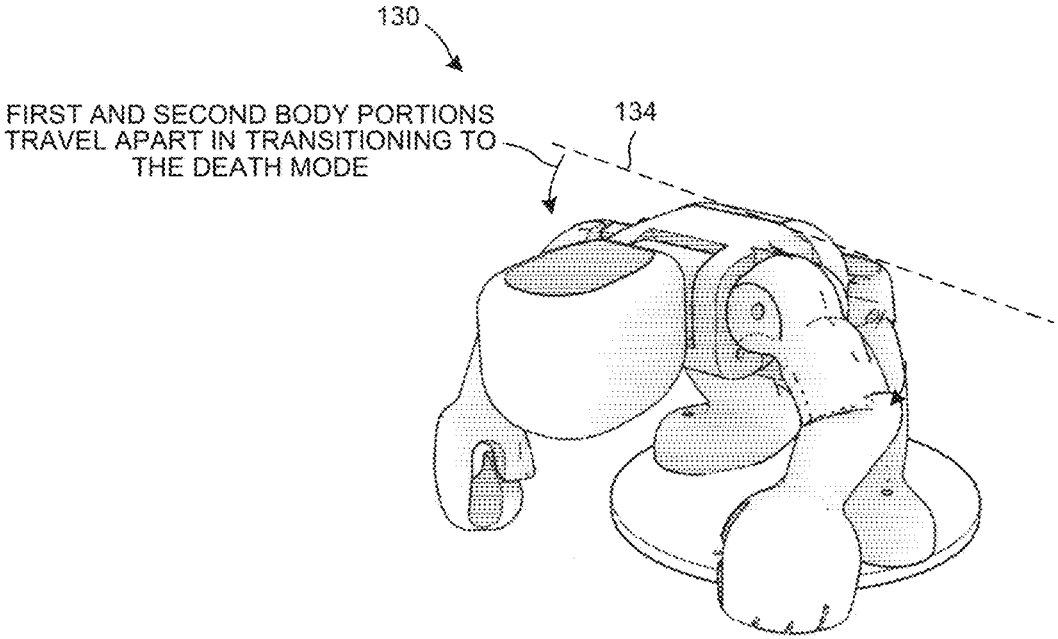
FIG. 33 is a diagram of a front perspective view showing the action figure 130 in the collapse forward death mode.

FIG. 32 is a diagram of a front perspective view showing an embodiment of an action figure 130 with a collapse forward death mode. Action figure 130 has a first body portion 131, a second body portion 132, and a trigger portion 133. When the action figure 130 is struck at the trigger portion 133, the first body portion 131 and the second body portion 132 separate along a midsection 134 that is parallel to the torso. Reference numeral 134 identifies the midsection along which the body portions 131 and 132 separate when trigger portion 133 is activated.

FIG. 33 is a diagram of a front perspective view showing the action figure 130 in the collapse forward death mode. In the collapse forward death mode, the first body portion 131 travels away and separates from the second body portion 132. During this death mode, the first body portion 131 and second body portion 132 are released and the first body portion 131 collapses forwards. The first body portion 131 rotates about a pin 135 (shown in FIG. 32) that extends through a torso of the action figure 130. In this death mode embodiment, the first body portion 131 and the second body portion 132 remain attached to the action figure 130. In other embodiments, an item is optionally revealed upon entering the collapse forward death mode.

Figure 34:
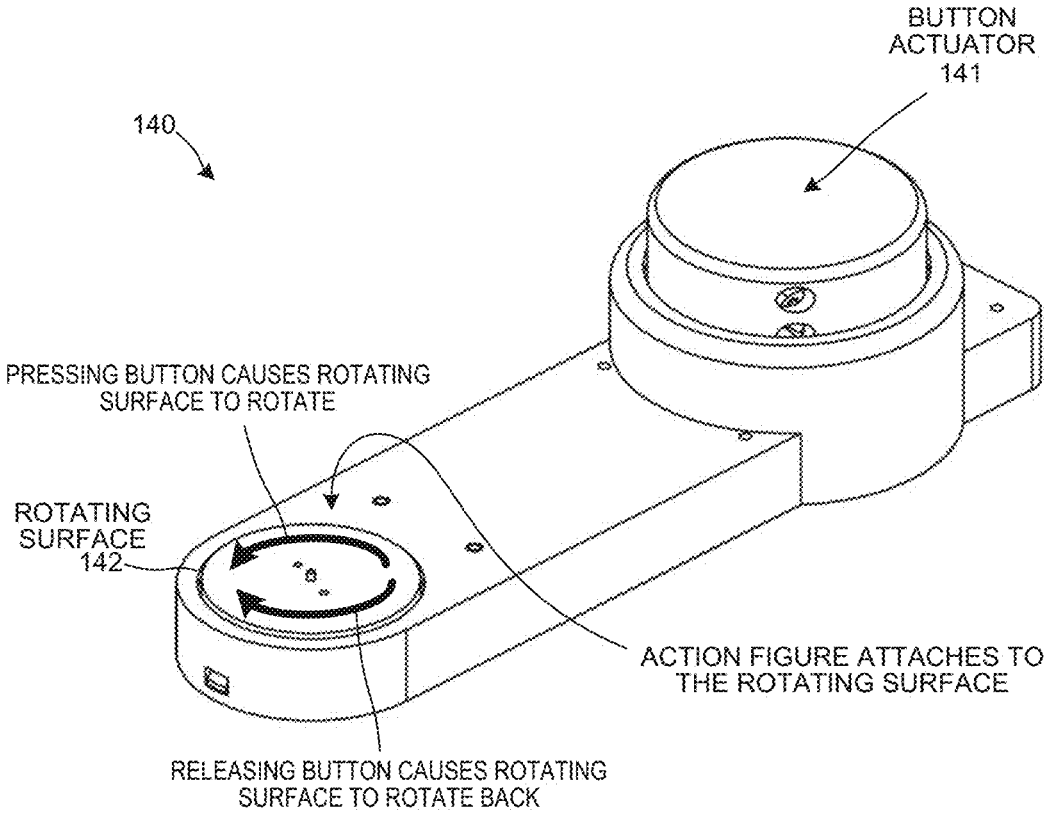
FIG. 34 is a diagram of a perspective view of one embodiment of a controller 140 without an action figure attached.

FIG. 34 is a diagram of a perspective view of one embodiment of a controller 140 without an action figure attached. Controller 140 includes an actuator 141 and a rotating surface 142. An action figure base attaches to the rotating surface 142. Control of the actuator 141 causes an action figure attached to the rotating surface 142 to rotate along with the rotating surface 142 and to transition from the idle mode to the attack mode. In this embodiment, the actuator 141 is a button actuator. When button actuator 141 is pressed, the rotating surface 142 rotates into the attack mode, and when button actuator 141 is released, the rotating surface 142 rotates back to the idle mode. In this example, the rotating surface 142 rotates counter-clockwise upon press of the button actuator 141 and rotates clockwise upon release of the button actuator 141. In other embodiments, the rotating surface 142 rotates clockwise upon press of the button actuator 141 and rotates counter-clockwise upon release of the button actuator 141.

Figure 35:
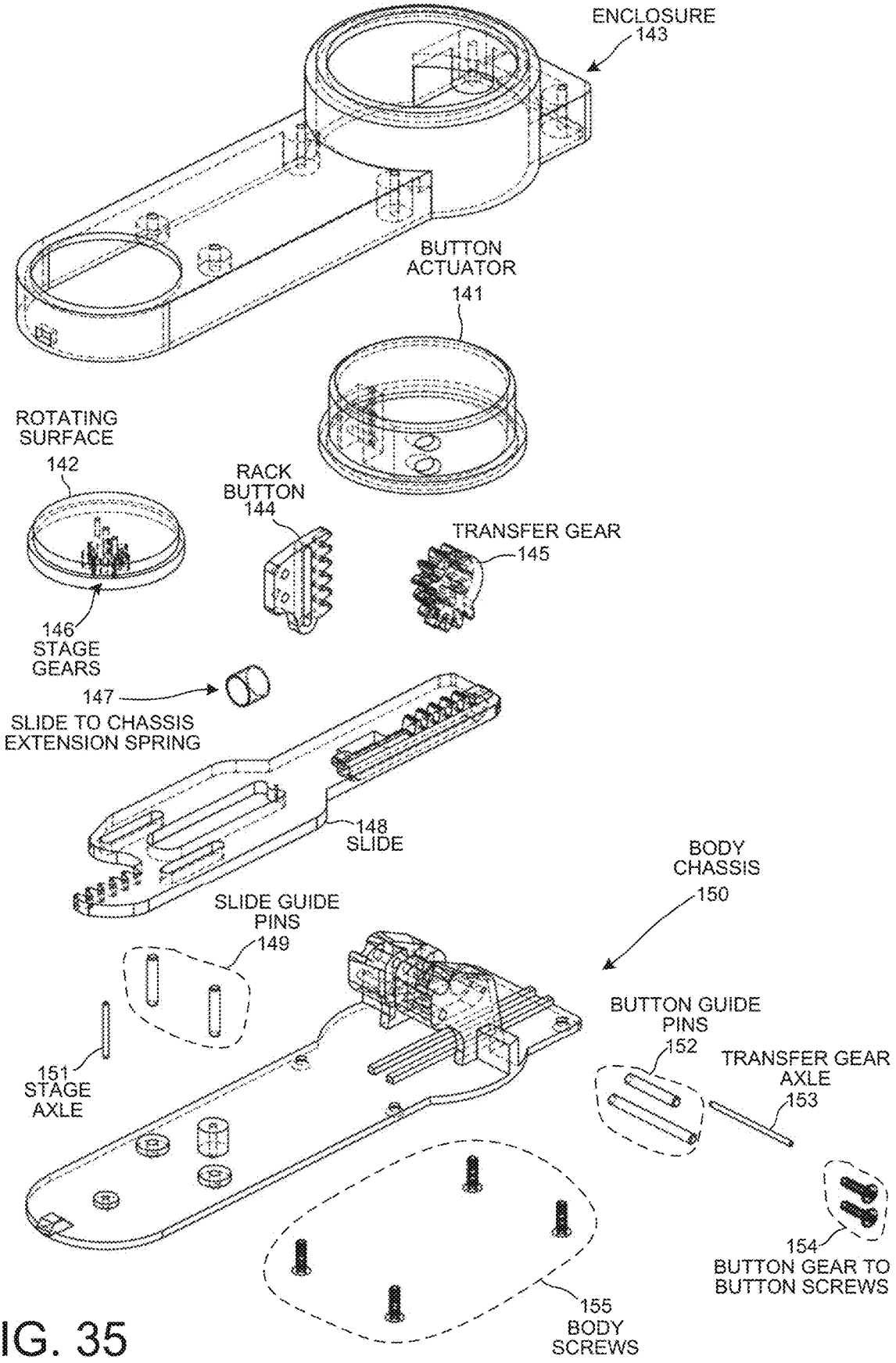
FIG. 35 is a diagram of an exploded view of the controller 140 controlled via the button actuator 141.

FIG. 35 is a diagram of an exploded view of the controller 140 controlled via the button actuator 141. Controller 140 comprises the button actuator 141, the rotating surface 142, an enclosure 143, a rack button 144, a transfer gear 145, stage gears 146, extension spring 147, slide 148, slide guide pins 149, body chassis 150, stage axle 151, button guide pins 152, transfer gear axle 153, button gear to button screws 154, and body screws 155.

Figure 36:
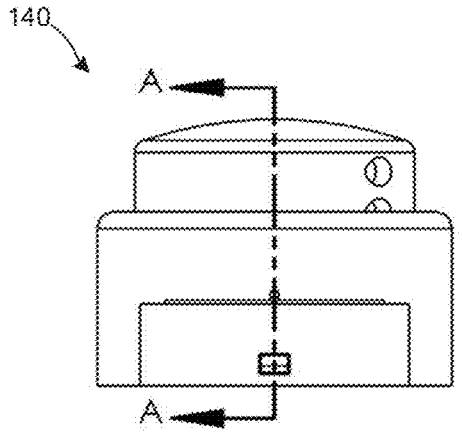
FIG. 36 is a diagram of a front view of the controller 140 controlled via the button actuator 141.

FIG. 36 is a diagram of a front view of the controller 140 controlled via the button actuator 141. A cross-section A-A is identified in FIG. 36.

Figure 37:
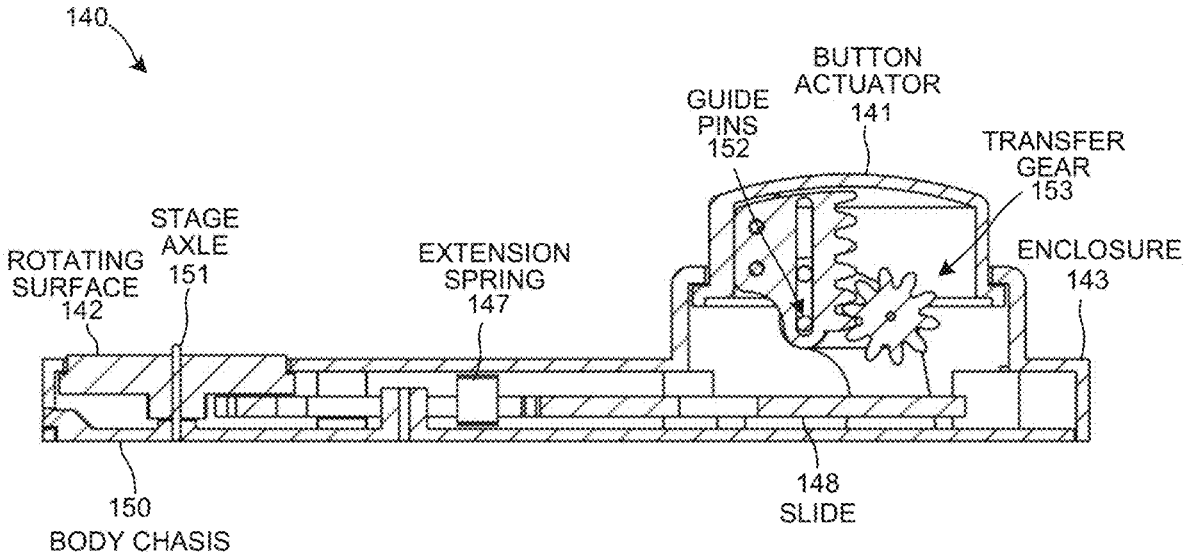
FIG. 37 is a diagram of a side view of the controller 140 along the cross-section A-A.

FIG. 37 is a diagram of a side view of the controller 140 along the cross-section A-A. When button actuator 141 is pressed, slide 148 is actuated via the transfer gear 153. Slide 148 rotates surface 142 about the axle 151.

Figure 38:
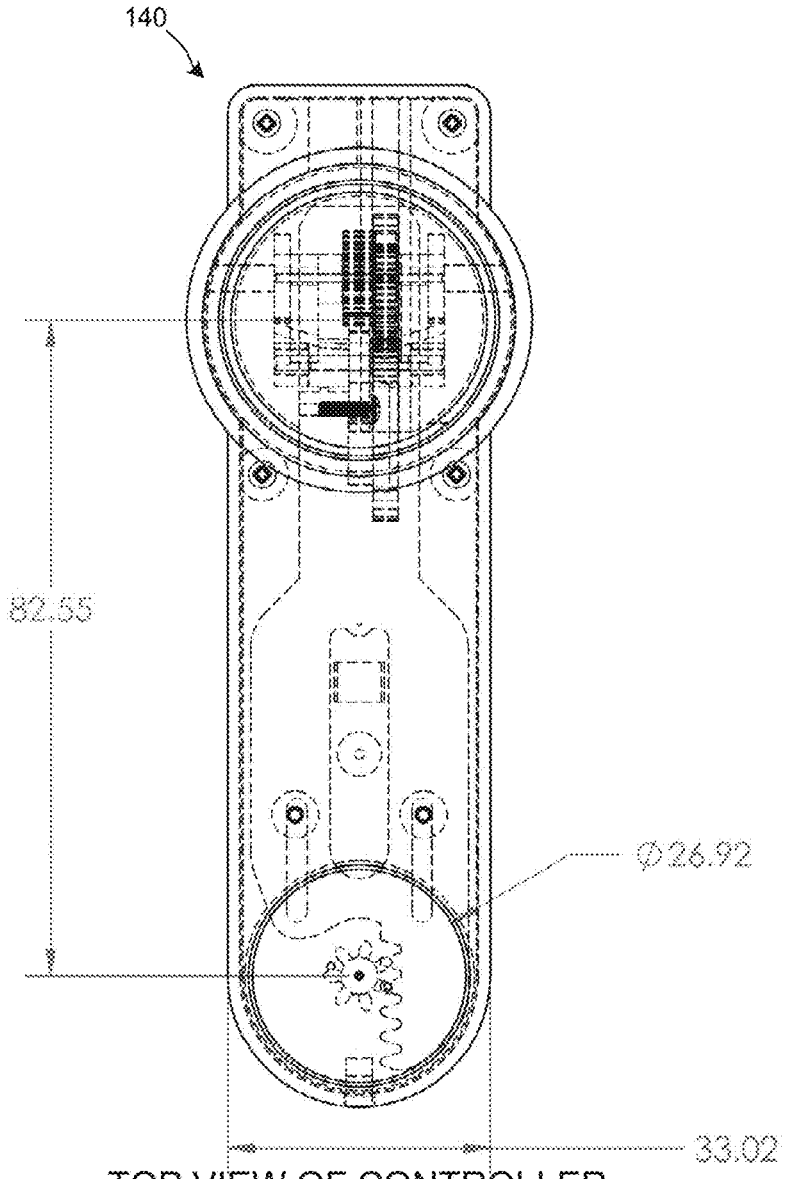
FIG. 38 is a diagram of a top view of the controller 140 showing dimensions of one embodiment.

FIG. 38 is a diagram of a top view of the controller 140 showing dimensions of one embodiment.

Figure 39:
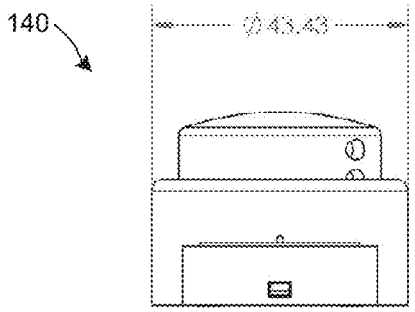
FIG. 39 is a diagram of a front view of the controller 140 showing dimensions of one embodiment.

FIG. 39 is a diagram of a front view of the controller 140 showing dimensions of one embodiment.

FIG. 40 is a diagram of a left-side view of the controller 140 showing dimensions of one embodiment.

Figure 41:
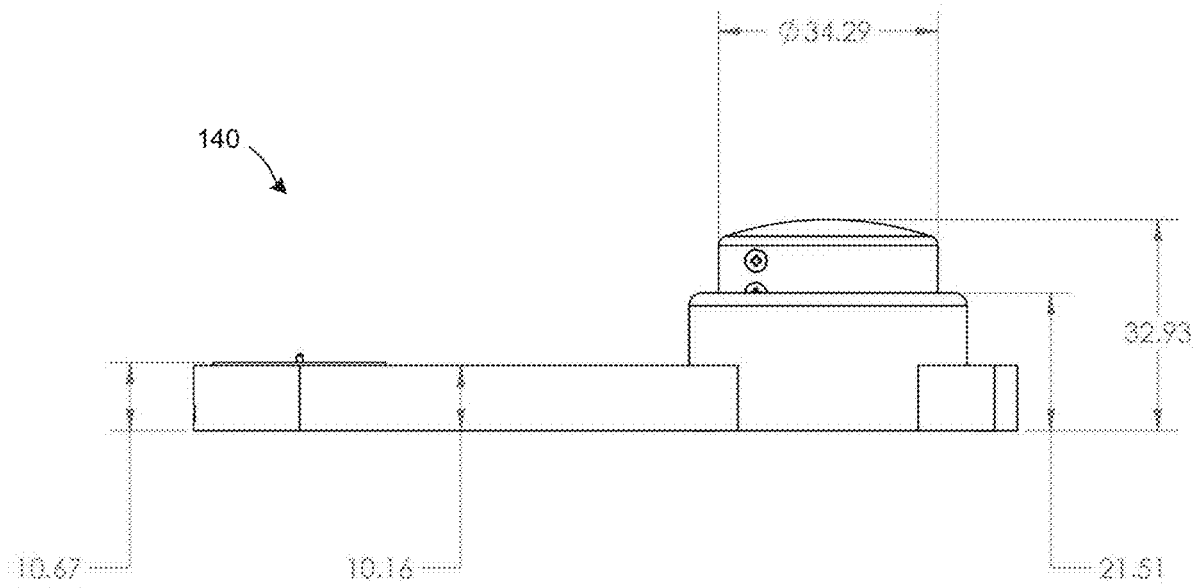
FIG. 41 is a diagram of a right-side view of the controller 140 showing dimensions of one embodiment.

FIG. 41 is a diagram of a right-side view of the controller 140 showing dimensions of one embodiment.

Figure 42:
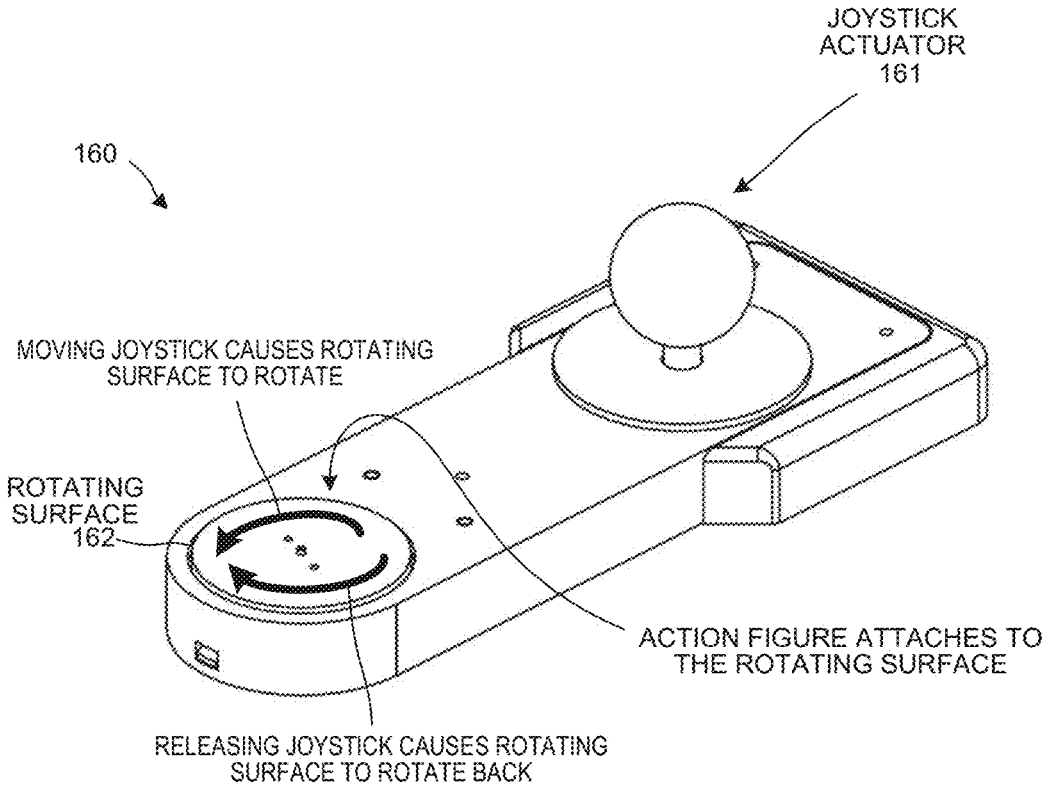
FIG. 42 is a diagram of a perspective view of another embodiment of a controller 160 without an action figure attached.

FIG. 42 is a diagram of a perspective view of another embodiment of a controller 160 without an action figure attached. Controller 160 includes an actuator 161 and a rotating surface 162. An action figure base attaches to the rotating surface 162. Control of the actuator 161 causes an action figure attached to the rotating surface 162 to rotate along with the rotating surface 162 and to transition from the idle mode to the attack mode. In this embodiment, the actuator 161 is a joystick actuator. When joystick actuator 161 is pushed or pulled, the rotating surface 142 rotates into the attack mode, and when joystick actuator 161 is released, the rotating surface 162 rotates back to the idle mode. In this example, the rotating surface 162 rotates counter-clockwise upon push or pull of the joystick actuator 161 and rotates clockwise upon release of the joystick actuator 161. In other embodiments, the rotating surface 162 rotates clockwise upon push or pull of the joystick actuator 161 and rotates counter-clockwise upon release of the joystick actuator 161.

Figure 43:
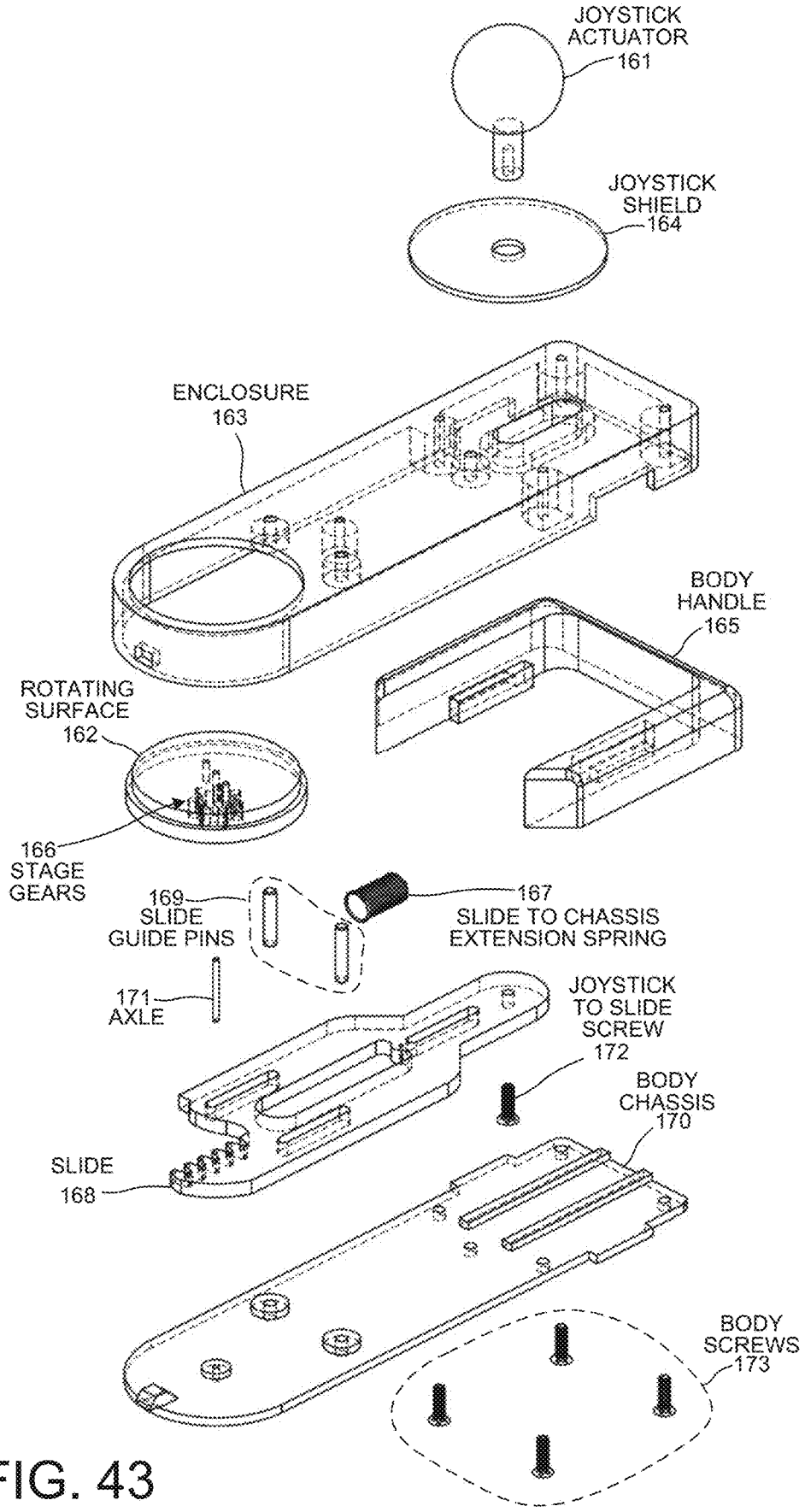
FIG. 43 is a diagram of an exploded view of the controller 160 controlled via the joystick actuator 161.

FIG. 43 is a diagram of an exploded view of the controller 160 controlled via the joystick actuator 161. Controller 160 comprises the joystick actuator 161, the rotating surface 162, an enclosure 163, a joystick shield 164, a body handle 165, stage gears 166, extension spring 167, slide 168, slide guide pins 169, body chassis 170, axle 171, joystick to slide screw 172, and body screws 173.

Figure 44:
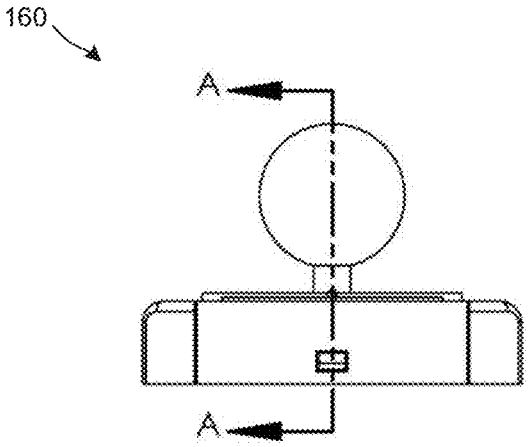
FIG. 44 is a diagram of a front view of the controller 160 controlled via the joystick actuator 161.

FIG. 44 is a diagram of a front view of the controller 160 controlled via the joystick actuator 161. A cross-section A-A is identified in FIG. 44.

Figure 45:
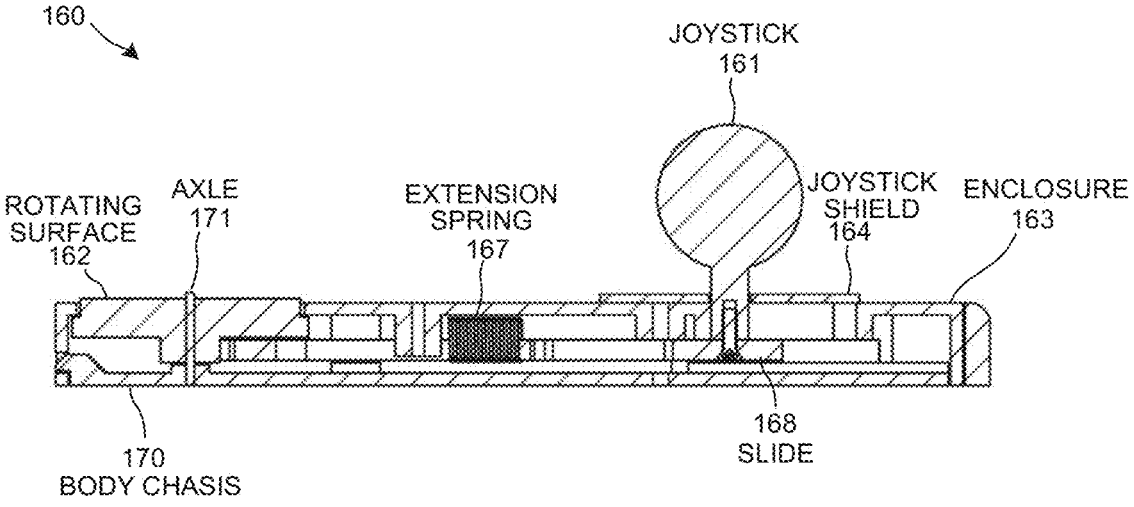
FIG. 45 is a diagram of a side view of the controller 160 along the cross-section A-A.

FIG. 45 is a diagram of a side view of the controller 160 along the cross-section A-A. When the joystick actuator 161 is pushed or pulled, slide 168 is actuated causing slide 168 to rotate surface 162 about the axle 171.

Figure 46:
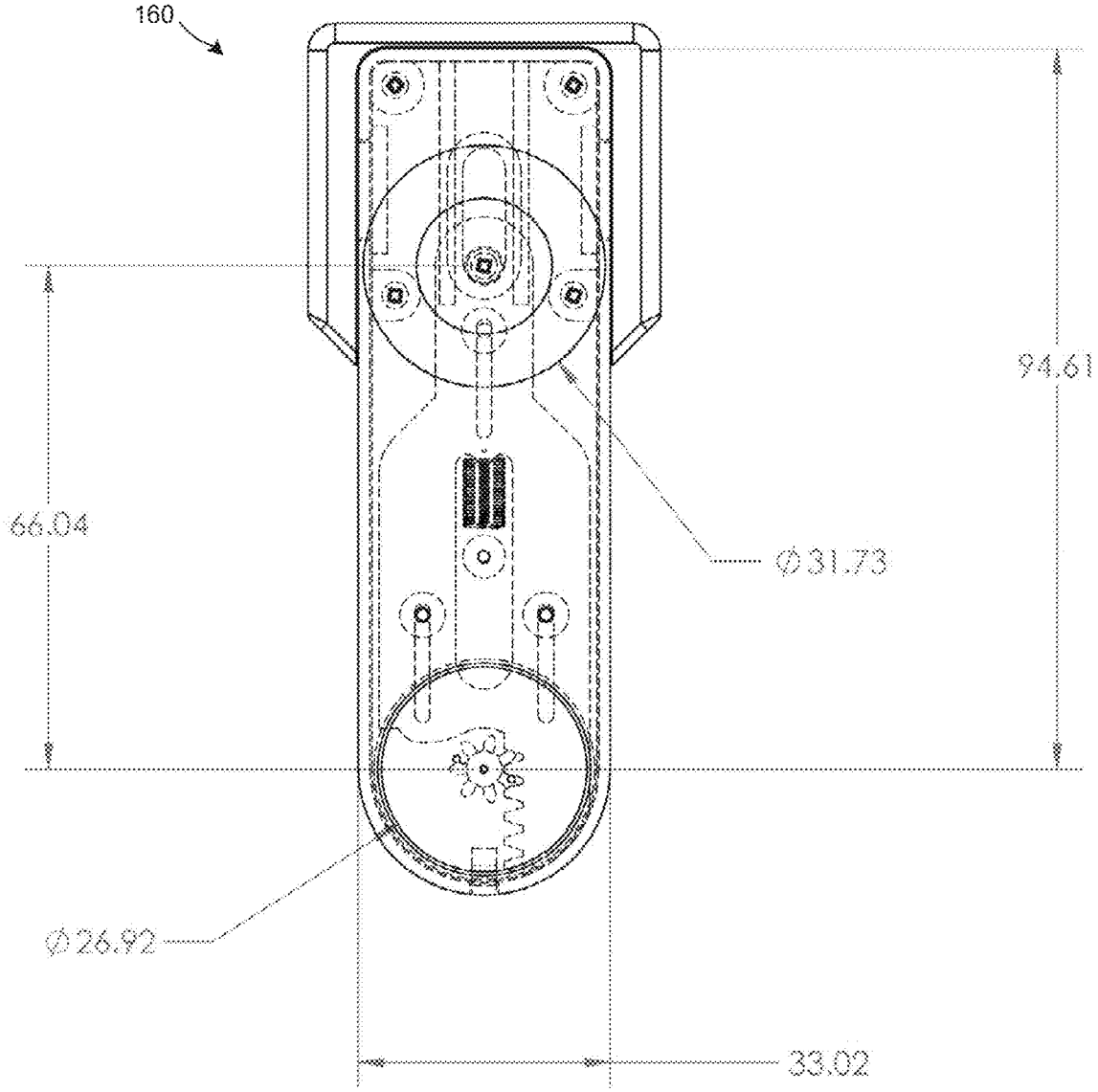
FIG. 46 is a diagram of a top view of the controller 160 showing dimensions of one embodiment.

FIG. 46 is a diagram of a top view of the controller 160 showing dimensions of one embodiment.

Figure 47:
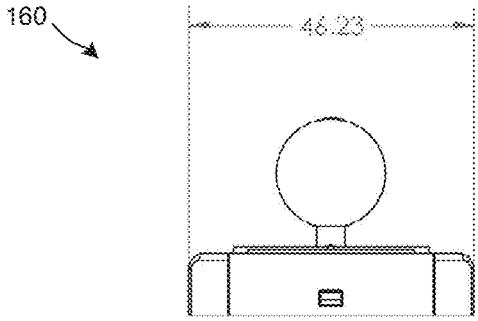
FIG. 47 is a diagram of a front view of the controller 160 showing dimensions of one embodiment.

FIG. 47 is a diagram of a front view of the controller 160 showing dimensions of one embodiment.

Figure 48:
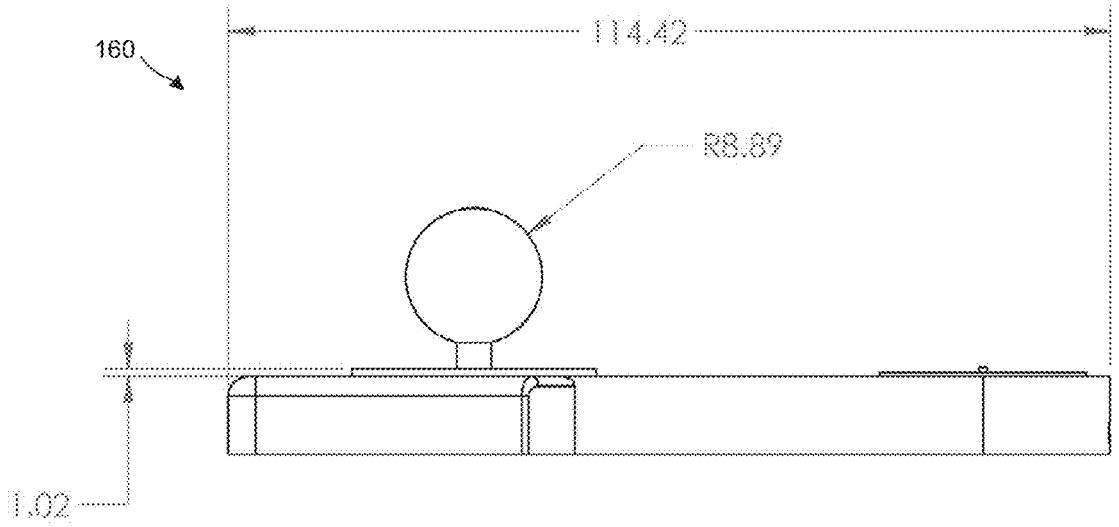
FIG. 48 is a diagram of a left-side view of the controller 160 showing dimensions of one embodiment.

FIG. 48 is a diagram of a left-side view of the controller 160 showing dimensions of one embodiment.

Figure 49:
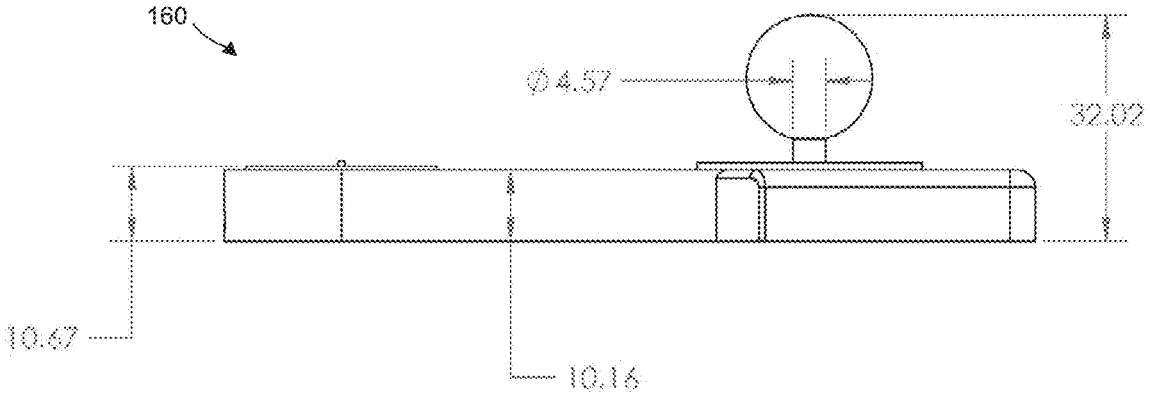
FIG. 49 is a diagram of a right-side view of the controller 160 showing dimensions of one embodiment.

FIG. 49 is a diagram of a right-side view of the controller 160 showing dimensions of one embodiment.

FIG. 50 is a diagram of another embodiment of a controller 180. Controller 180 includes electrical components involved in controlling an action figure (not shown). The action figure is attached to figure platform 181 and includes any of the various attack and death maneuvers as described herein. The controller 180 includes the figure platform 181, a PCB (printed circuit board) 182, one or more batteries 183, a power switch 184, a joystick 185, and an optional speaker 186. Power switch 184 turns a controller on the PCB 182 on or off. Circuitry on the PCB 182 detects user input on the joystick 185 and causes the figure platform 181 to rotate accordingly. An optional speaker 186 generates various sound effects or pre-recorded audio output of the user recorded using an optional microphone 187. The one or more batteries 183 supply the circuitry of the controller 180. In one embodiment, the batteries 183 are rechargeable and a charging port is included that provides re-charging capability to the batteries 183.

Figure 51:
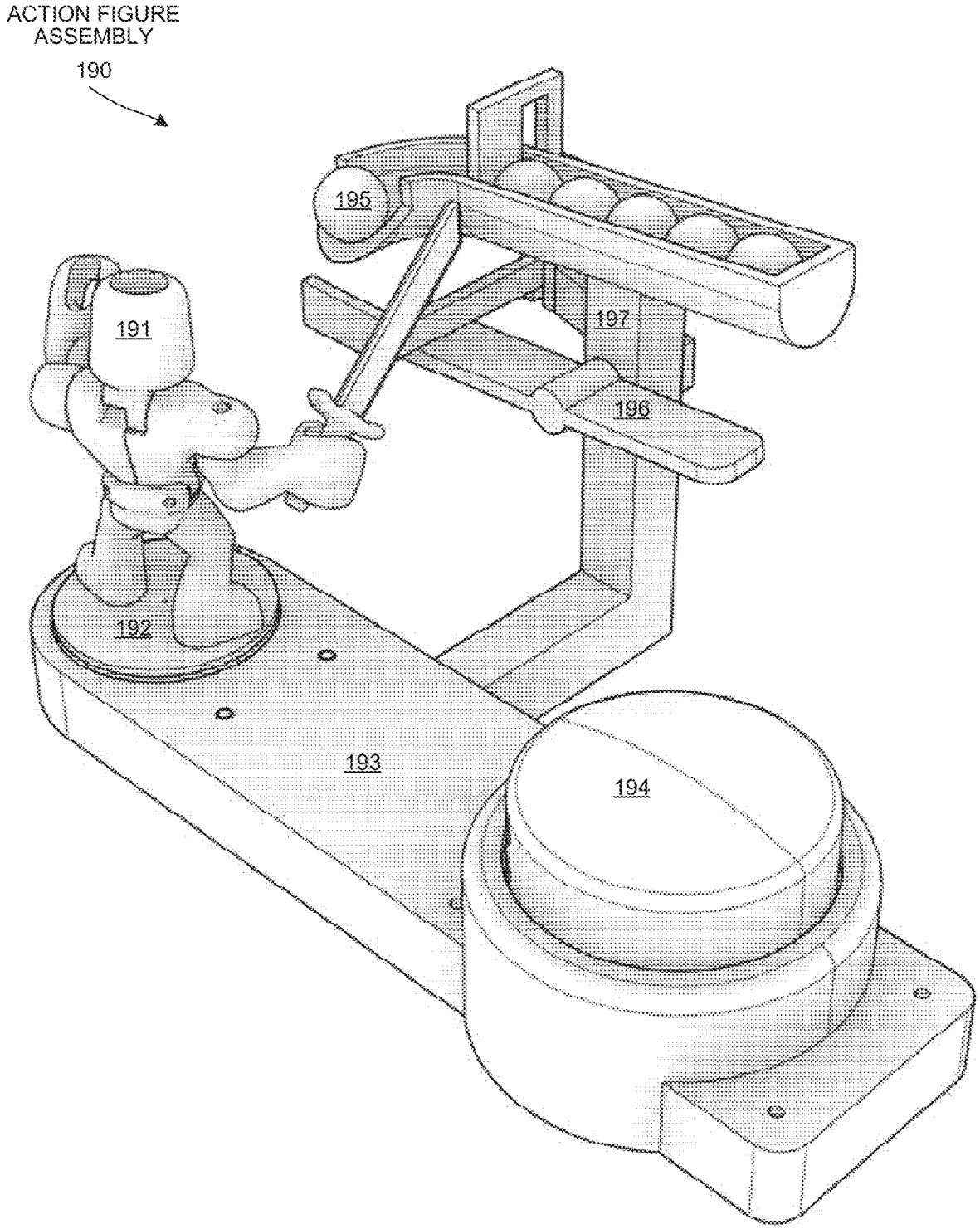
FIG. 51 is a diagram of another embodiment of an action figure assembly 190.

FIG. 51 is a diagram of another embodiment of an action figure assembly 190. The action figure assembly 190 includes an action figure 191, a rotating surface 192, a controller 193, an actuator 194, a projectile 195, a latch 196, and a structure 197. In this embodiment, the action figure 191 performs a strike maneuver by interacting with a device attachable to the controller 193. The action figure 191 rotates along with rotating surface 192. As the action figure 191 rotates, the action figure 191 strikes the projectile 195 thereby striking an opponent. Structure 197 is attached to the controller 193 and dispenses projectiles 195. Latch 196 controls dispensing of the projectiles.

Figure 52:
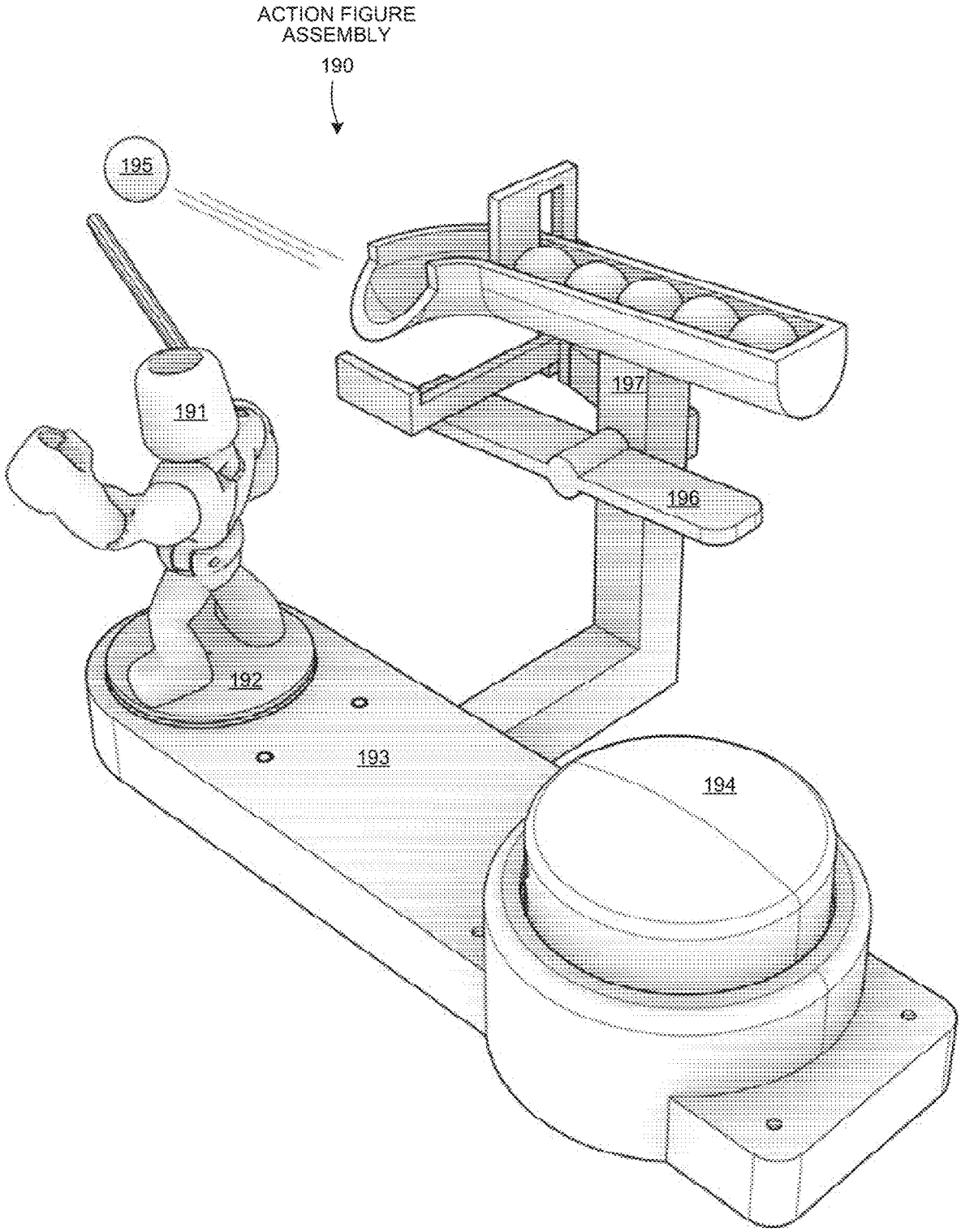
FIG. 52 is a diagram of the action figure assembly 190 striking through a projectile 195.

FIG. 52 is a diagram of the action figure assembly 190 striking through a projectile 195.

Figure 53:
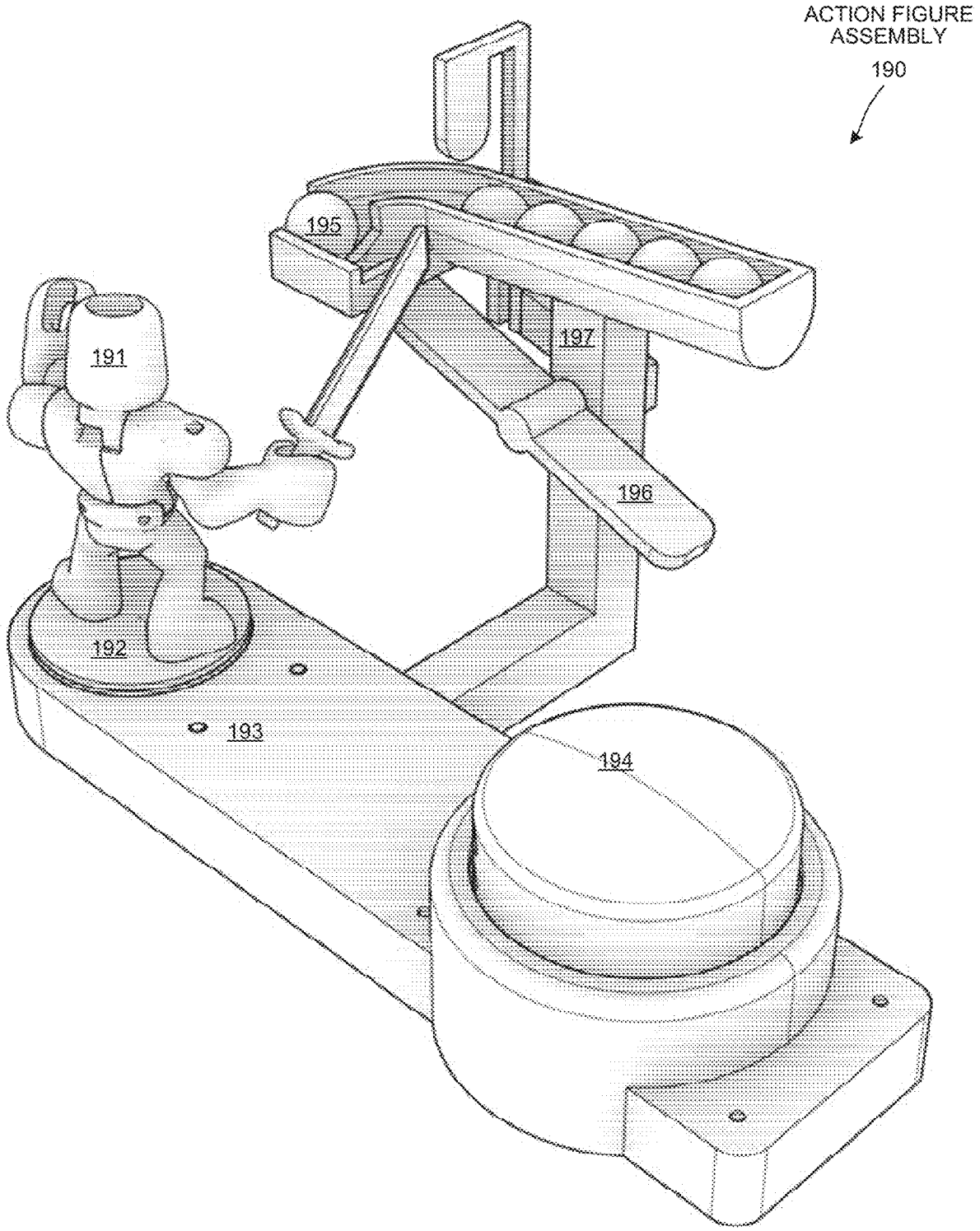
FIG. 53 is a diagram of the action figure assembly 190 configuring a new projectile 195.

FIG. 53 is a diagram of the action figure assembly 190 configuring a new projectile 195.

Figure 54:
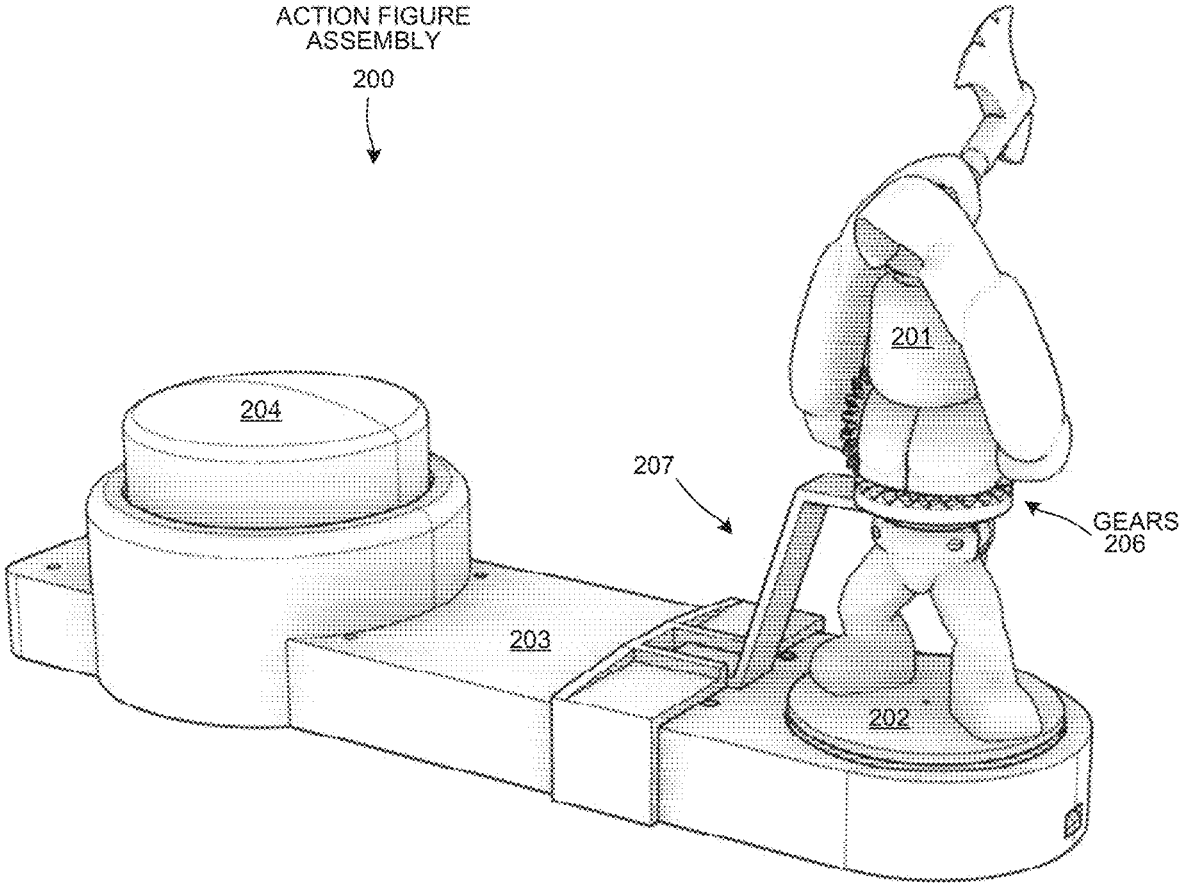
FIG. 54 is a diagram of another embodiment of an action figure assembly 200.

FIG. 54 is a diagram of another embodiment of an action figure assembly 200. The action figure assembly 200 includes an action figure 201, a rotating surface 202, a controller 203, an actuator 204, gears 206, and a structure 207. In this embodiment, the action figure 201 performs a strike maneuver by engaging a mechanism within the action figure. Gears 206 are within the action figure 201 and are engaged by structure 207 when the action figure 201 is rotated. The action figure 201 rotates along with rotating surface 202. As the action figure 201 rotates, gears 206 on the action figure 201 are engaged thereby causing the action figure 201 to strike an opponent.

Figure 55:
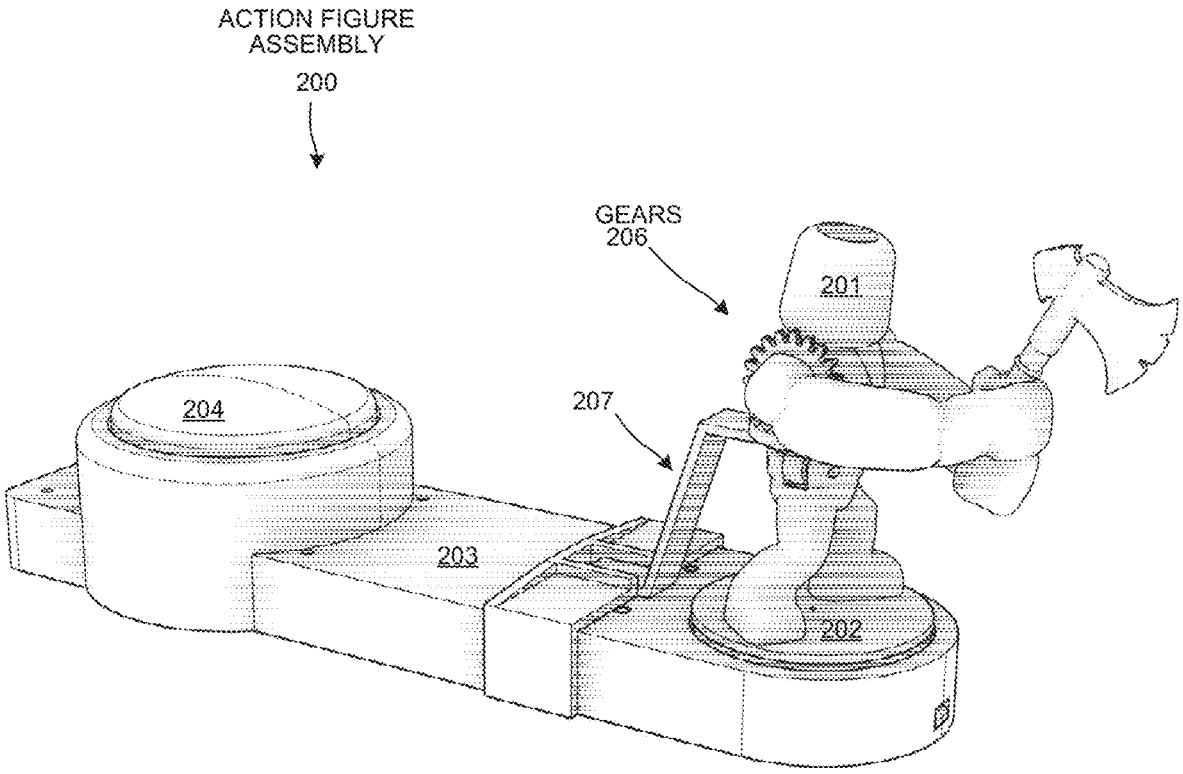
FIG. 55 is a diagram of the action figure assembly 200 performing a striking maneuver.

FIG. 55 is a diagram of the action figure assembly 200 performing a striking maneuver. In this example, gears 206 translate the rotation of action figure 201 about rotating surface 202 into a downward strike action perpendicular to the rotating surface 202.

Figure 56:
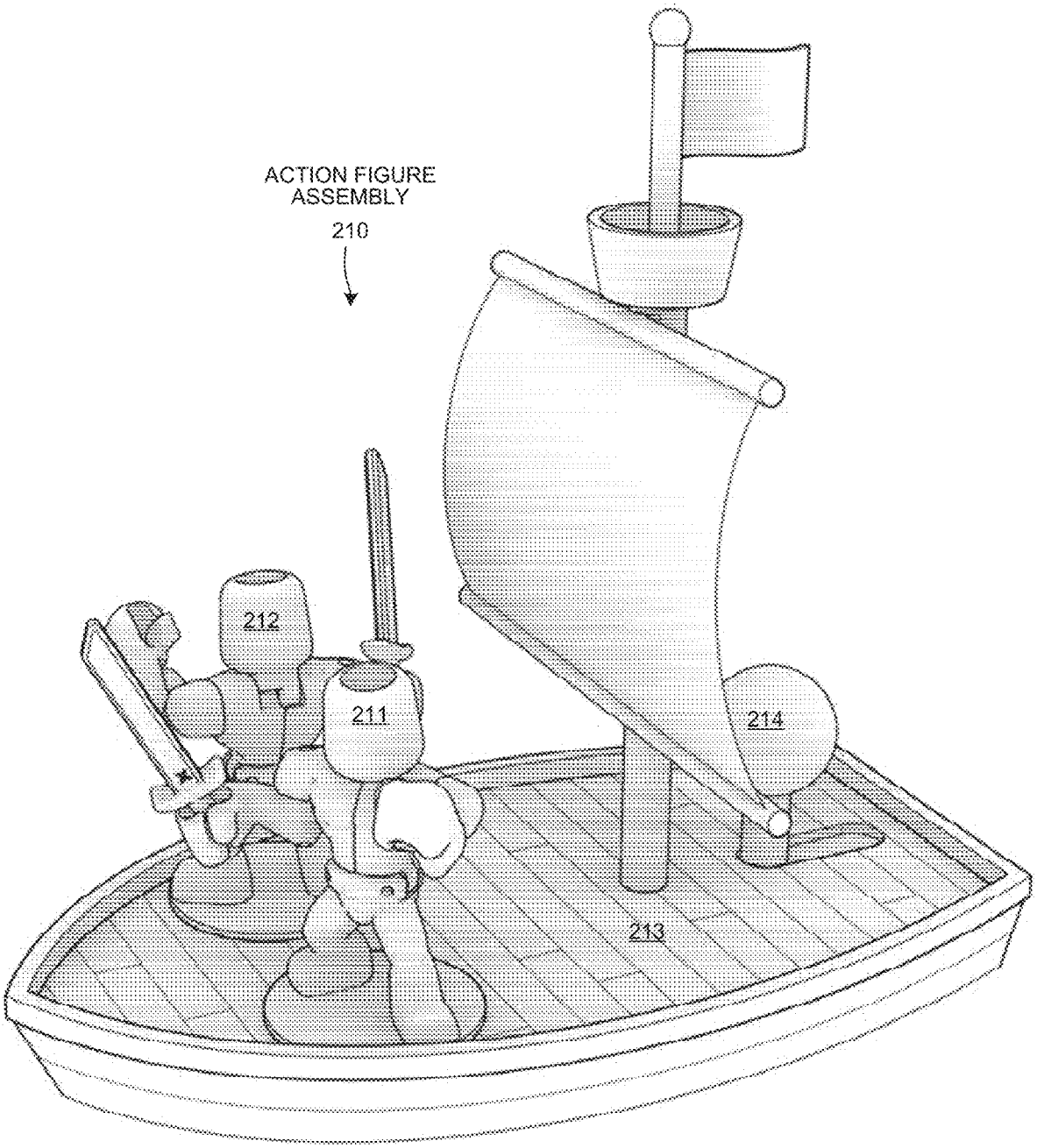
FIG. 56 is a diagram of another embodiment of an action figure assembly 210.

FIG. 56 is a diagram of another embodiment of an action figure assembly 210. The action figure assembly 210 includes two action figures 211 and 212 and a controller 213. An actuator 214 controls action figures 211 and 212 to perform strike maneuvers.

Figure 57:
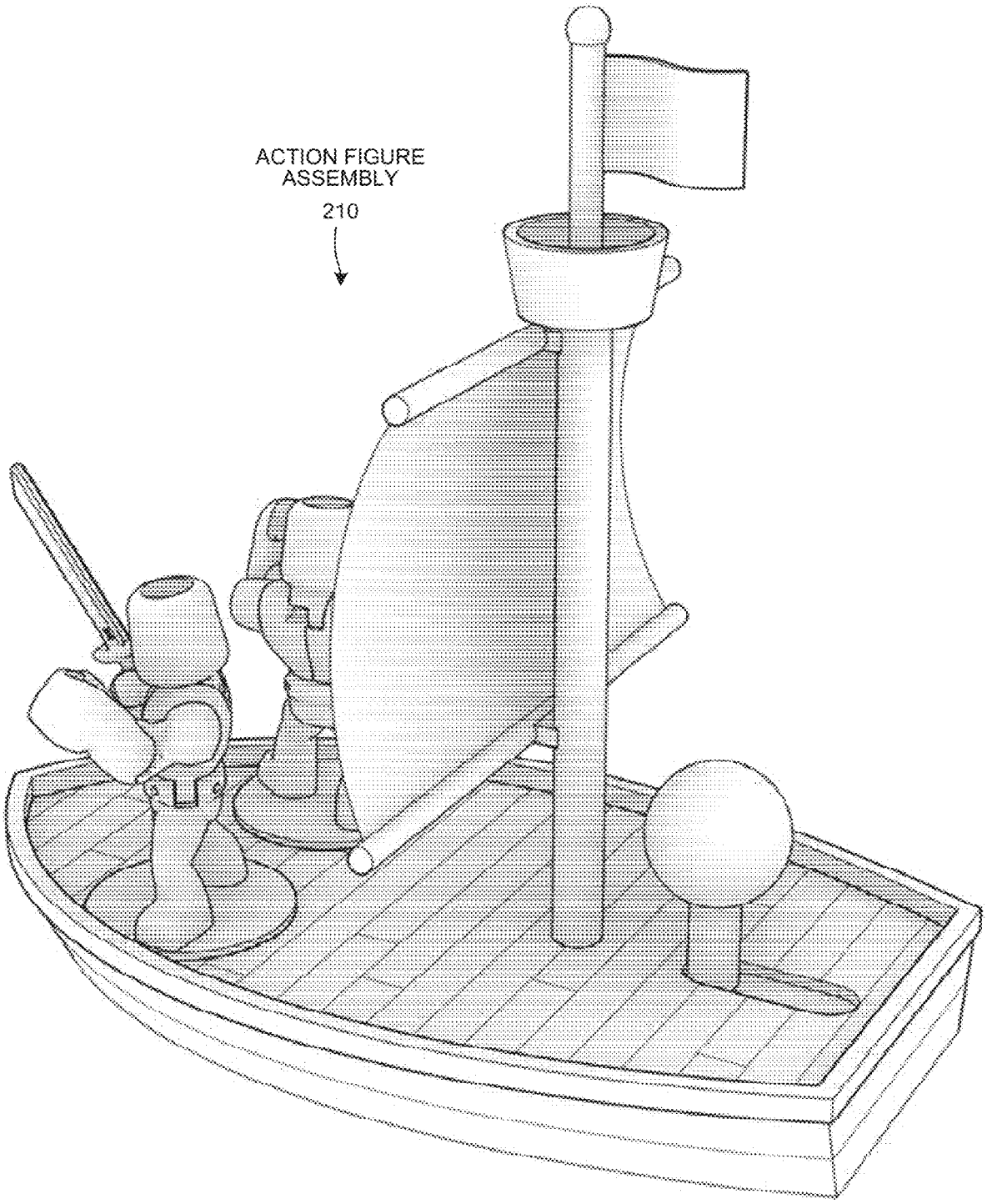
FIG. 57 is a diagram of another view of the action figure assembly 210.

FIG. 57 is a diagram of another view of the action figure assembly 210.

Figure 58:
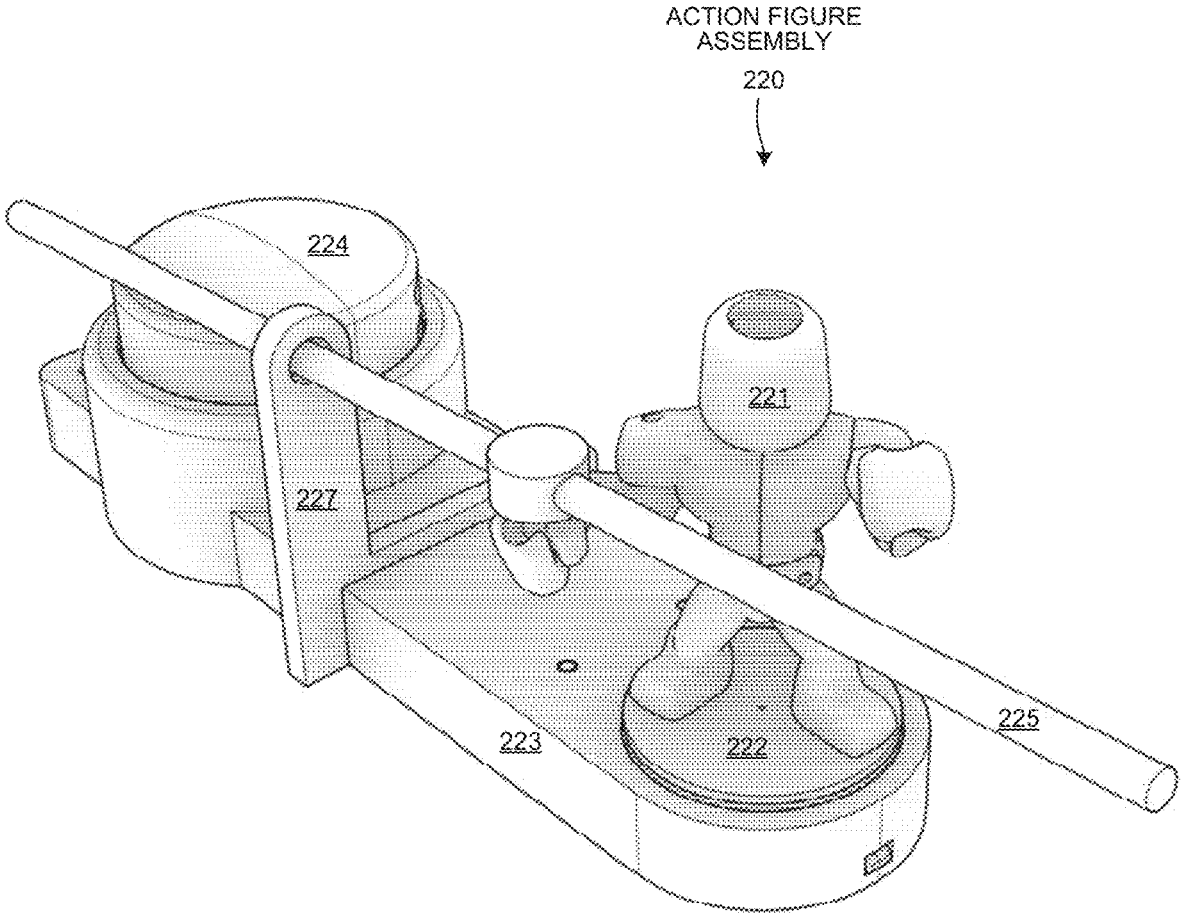
FIG. 58 is a diagram of another embodiment of an action figure assembly 220.

FIG. 58 is a diagram of another embodiment of an action figure assembly 220. The action figure assembly 220 includes an action figure 221, a rotating surface 222, a controller 223, an actuator 224, an attack element 225, and a structure 227. In this embodiment, the action figure 220 performs a strike maneuver by interacting with a device (227 and 225) attachable to the controller 193. The action figure 221 rotates along with rotating surface 222. As the action figure 221 rotates, the action figure 221 causes the attack element 225 to strike an opponent.

Figure 59:
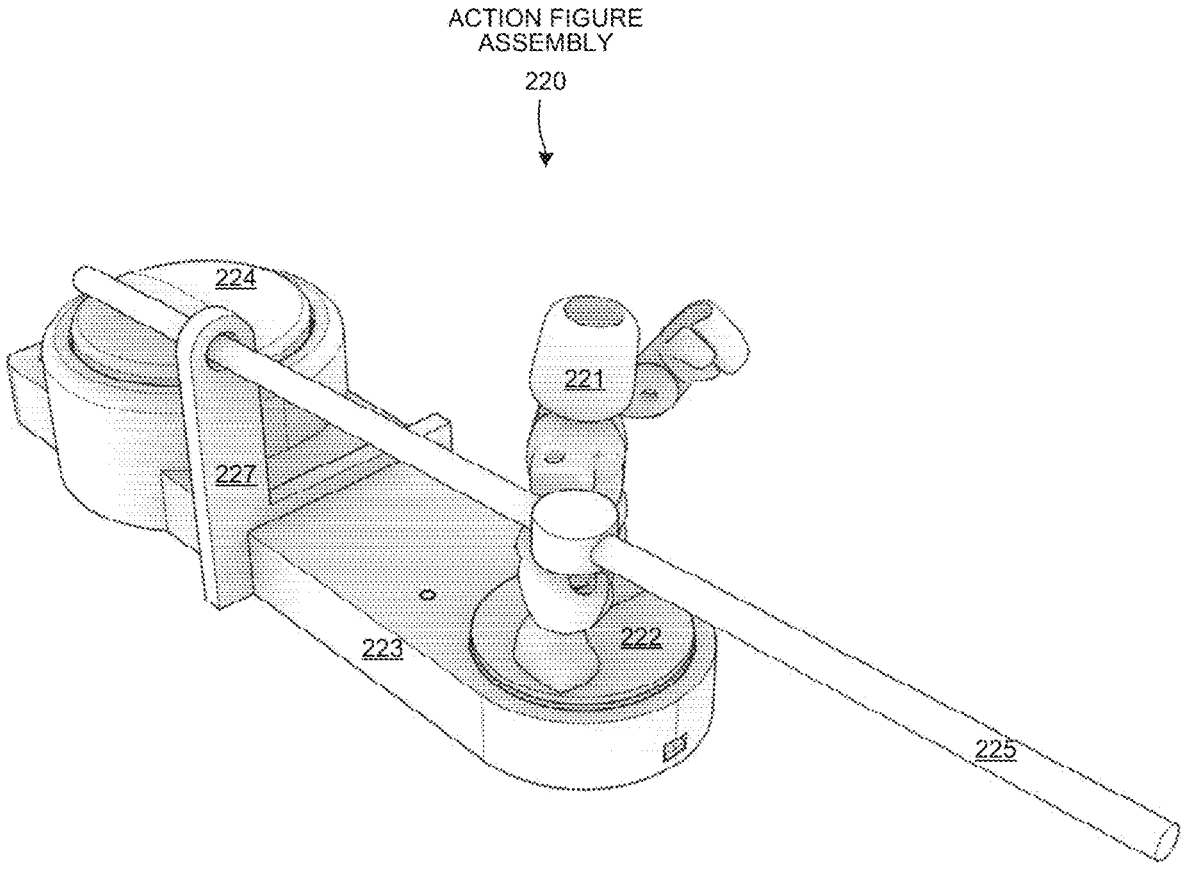
FIG. 59 is a diagram of the action figure assembly 220 performing a striking maneuver.

FIG. 59 is a diagram of the action figure assembly 220 performing a striking maneuver.

FIG. 60 is a diagram of another embodiment of an action figure 230 that includes electrical components. In some embodiments, the action figure assembly includes an action figure having electrical components such as input sensors and output components. In this example, the action figure 230 includes a switch or controller 231, a battery 232, an output device 233, and an input sensor 234. Although block 231 represents both a switch and controller, it is understood that the circuitry within action figure 230 may be more simple or more complicated depending on the electronics to be included within the action figure 230.

The battery 232 supplies circuitry within the action figure 230. The battery 232 is a rechargeable battery or a non-rechargeable battery. The output component 233 generates an output signal, such as an audio signal, visual signal, or wireless signal. For example, the output component 233 may be a speaker that generates sound effects, an LED that outputs light, a transmitter that outputs a wireless signal to be detected by another action figure or device, or a mechanical action. The mechanical action might cause a strike maneuver to be engaged, a spring to be activated, a projectile to launch, a latch to be triggered causing death or a change in configuration, or another type of mechanical action.

The input sensor 234 detects an input signal from outside of the action figure 230. For example, the input sensor 234 detects contact by another action figure or object that causes the action figure 230 to output sound effects, generate LED light output, or die. In one embodiment, there is only an output component 233 and no input sensor 234. In another embodiment, there is only an input sensor 234 and no output component 233. In yet another embodiment, there is both an output component 233 and an input sensor 234.

Figure 61:
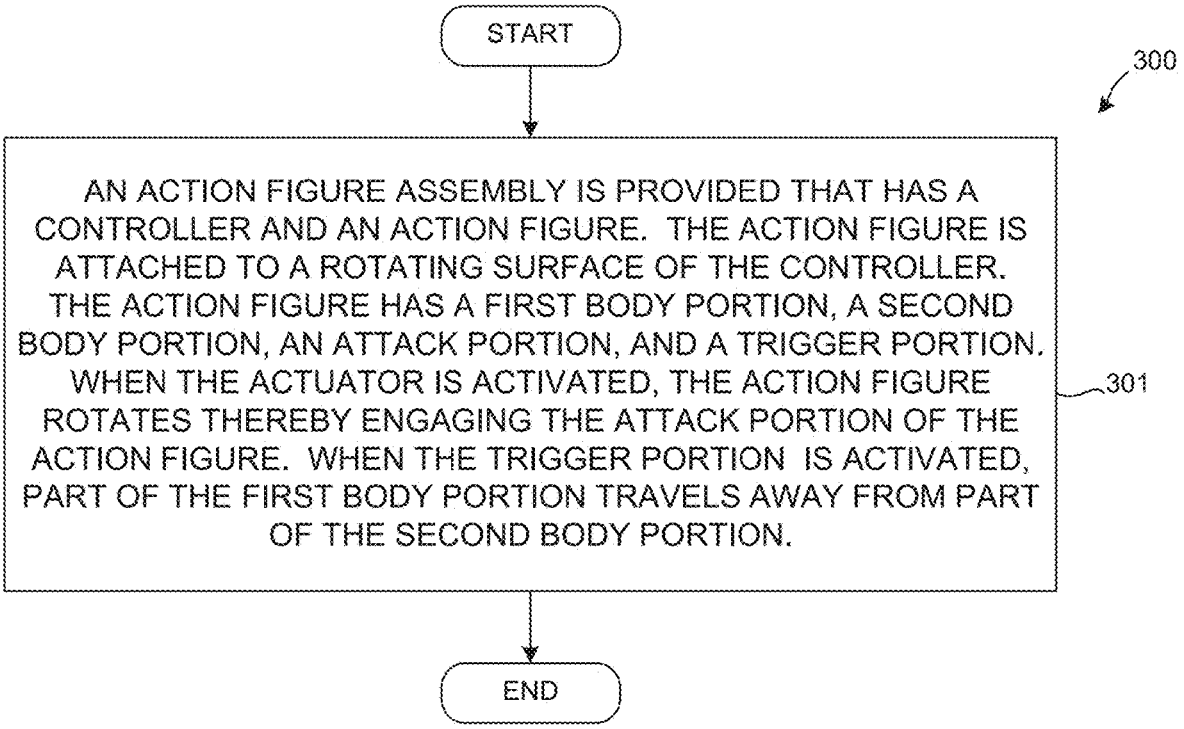
FIG. 61 is a flowchart of a method 300.

FIG. 61 is a flowchart of a method 300. In a first step (301), an action figure assembly is provided that has a controller and an action figure. The action figure is attached to a rotating surface of the controller. The action figure has a first body portion, a second body portion, an attack portion, and a trigger portion. When the actuator is activated, the action figure rotates thereby engaging the attack portion of the action figure. When the trigger portion is activated, part of the first body portion travels away from part of the second body portion.

Figure 62:
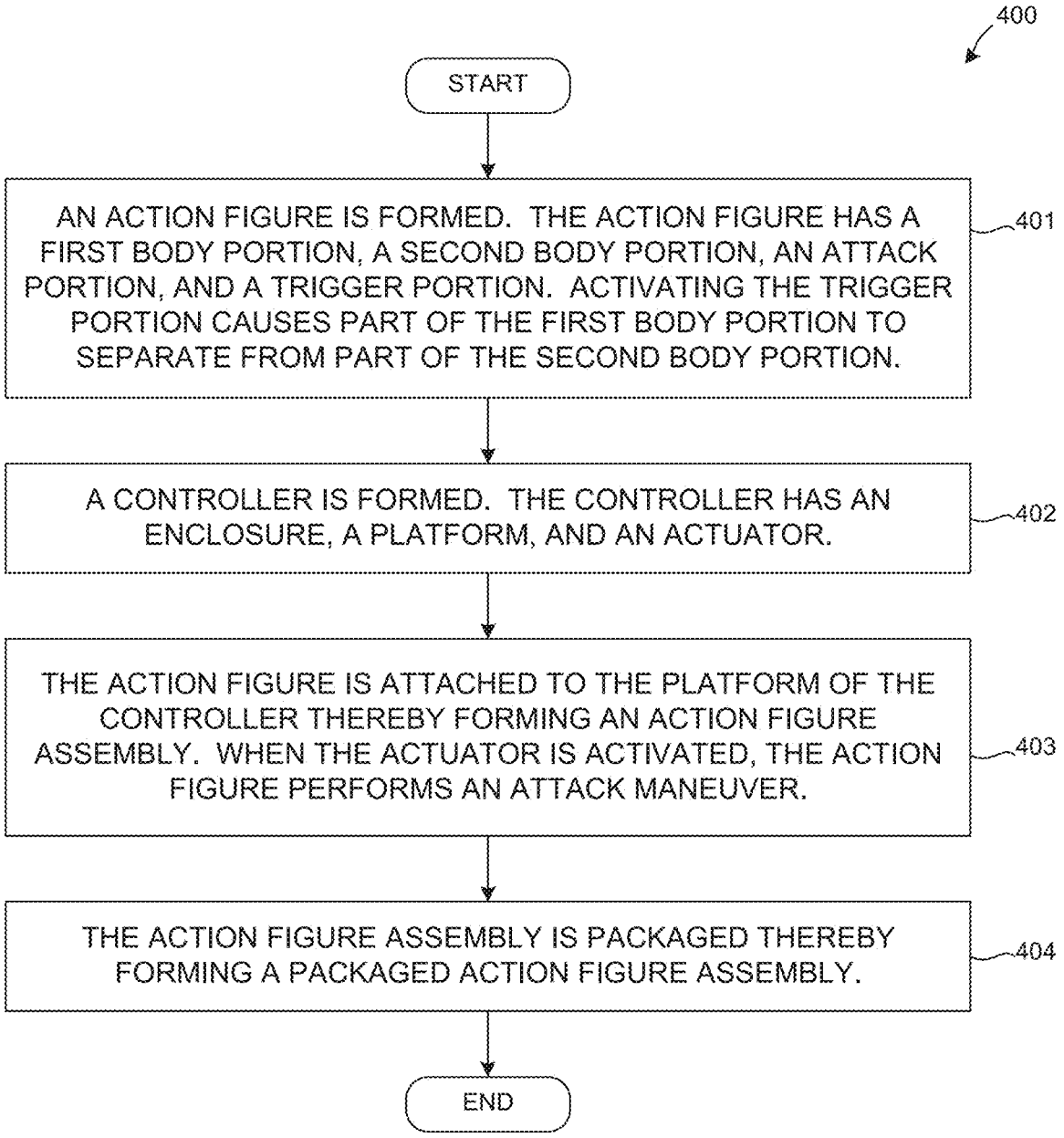
FIG. 62 is a flowchart of a method 400.

FIG. 62 is a flowchart of a method 400. In a first step (401), an action figure is formed. The action figure has a first body portion, a second body portion, an attack portion, and a trigger portion. Activating the trigger portion causes part of the first body portion to separate from part of the second body portion.

In a second step (402), a controller is formed. The controller has an enclosure, a platform, and an actuator.

In a third step (403), the action figure is attached to the platform of the controller thereby forming an action figure assembly. When the actuator is activated, the action figure performs an attack maneuver.

In a fourth step (404), the action figure assembly is packaged thereby forming a packaged action figure assembly.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. An assembly comprising:

a controller having an enclosure, an actuator, and a rotating surface, wherein the rotating surface rotates in response to activation of the actuator; and an action figure attached to the rotating surface of the controller, wherein the action figure has a first body portion, a second body portion, an attack portion, and a trigger portion, wherein when the actuator of the controller is activated, the action figure rotates with the rotating surface thereby causing the action figure to perform an attack maneuver, and wherein when the trigger portion is activated, the trigger portion moves away from the first body portion and the second body portion thereby causing the figure to split apart.

2. The assembly of claim 1, wherein at least part of the action figure remains attached to the rotating surface after the trigger portion is activated.

3. The assembly of claim 1, wherein the trigger portion comprises a head and a latch, wherein the head is connected to the latch, wherein the latch holds the first body portion and the second body portion together, wherein the trigger portion is activated by moving the head causing the latch to release the first body portion and the second body portion.

4. The assembly of claim 1, wherein before the trigger portion of the action figure is activated, part of the first body portion is adjacent to part of the second body portion, and wherein the first body portion and the second body portion separate along a separation axis.

5. The assembly of claim 1, wherein engaging the attack maneuver of the action figure causes the attack portion to rotate about a pin.

6. The assembly of claim 1, wherein the attack maneuver involves an element taken from the group consisting of: an arm holding a weapon operable to perform a weapon striking maneuver, an arm operable to perform a punching maneuver, a leg operable to perform a kicking maneuver, a torso operable to perform a lean and slap striking maneuver, and a telescoping first operable to perform a telescoping arm striking maneuver.

7. The assembly of claim 1, wherein when the trigger portion of the action figure is activated, the first body portion separates from the second body portion causing an item partially concealed within the action figure to be released.

8. The assembly of claim 1, wherein the action figure selectably receives a weapon that is attached to or removed from the action figure based on user preference.

9. The assembly of claim 1, wherein activation of the trigger portion causes the first body portion and the second body portion to rotate away from each other about pins of the action figure.

10. The assembly of claim 1, wherein activation of the trigger portion causes the first body portion and the second body portion to completely separate from the action figure so that only part of the action figure is attached to the rotating surface of the controller.

11. The assembly of claim 1, wherein activation of the trigger portion causes the rotating surface to split apart and also causes the action figure to split apart.

12. The assembly of claim 1, wherein the first body portion is above the second body portion, wherein the second body portion is connected to the rotating surface of the controller, and wherein activation of the trigger portion causes the first body portion to rotate forwards or backwards away from the second body portion.

13. The assembly of claim 1, wherein the actuator of the controller is taken from the group consisting of: a joystick actuator and a button actuator.

14. The assembly of claim 1, wherein the action figure includes a blocking portion that rotates about a pin, wherein actuation of the actuator causes the action figure to rotate along an attack rotation path, and wherein release of the actuator causes the action figure to rotate along a return rotation path.

15. The assembly of claim 1, wherein the attack maneuver involves engaging a mechanism within the action figure.

16. The assembly of claim 1, wherein the attack maneuver involves the action figure interacting with a device attachable to the controller.

17. A method comprising:

providing action figure assembly having a controller and an action figure, wherein the action figure is attached to a rotating surface of the controller, wherein the action figure has a first body portion, a second body portion, an attack portion, and a trigger portion, wherein activating an actuator of the controller causes the action figure to rotate and perform an attack maneuver, and wherein activating the trigger portion causes part of the first body portion to travel away from part of the second body portion.

18. The method of claim 17, wherein the action figure assembly is provided in a package that includes user instructions on how to activate the actuator.

19. The method of claim 17, further comprising:

providing one or more weapons, wherein each of the one or more weapons are interchangeably attachable to the action figure.

20. The method of claim 17, wherein the action figure assembly is a first action figure assembly operable by a first user, and wherein the method further comprises:

providing a second action figure assembly, wherein the second action figure assembly is operable by a second user, and wherein during game play, the second user controls the second action figure assembly to strike the trigger portion of the first action figure assembly thereby defeating the first user and winning a match.

* * * * *